US011882875B2

(12) United States Patent
Jung et al.

(10) Patent No.: US 11,882,875 B2
(45) Date of Patent: Jan. 30, 2024

(54) AEROSOL GENERATING APPARATUS AND OPERATION METHOD OF THE SAME

(71) Applicant: KT&G CORPORATION, Daejeon (KR)

(72) Inventors: Hyung Jin Jung, Seoul (KR); Hun Il Lim, Seoul (KR); Jin Soo Seong, Seoul (KR); Jae Sung Choi, Hanam-si (KR)

(73) Assignee: KT&G CORPORATION, Daejeon (KR)

( * ) Notice: Subject to any disclaimer, the term of this patent is extended or adjusted under 35 U.S.C. 154(b) by 763 days.

(21) Appl. No.: 17/041,161

(22) PCT Filed: Oct. 31, 2019

(86) PCT No.: PCT/KR2019/014562
§ 371 (c)(1),
(2) Date: Sep. 24, 2020

(87) PCT Pub. No.: WO2020/105896
PCT Pub. Date: May 28, 2020

(65) Prior Publication Data

US 2021/0007393 A1 Jan. 14, 2021

(30) Foreign Application Priority Data

Nov. 23, 2018 (KR) ..... 10-2018-0146769

(51) Int. Cl.
*A24F 13/00* (2006.01)
*A24F 40/20* (2020.01)
(Continued)

(52) U.S. Cl.
CPC ..... *A24F 40/20* (2020.01); *A24F 40/465* (2020.01); *A24F 40/57* (2020.01)

(58) Field of Classification Search
CPC ..... A24F 47/00
(Continued)

(56) References Cited

U.S. PATENT DOCUMENTS 5,902,501 A 5/1999 Nunnally et al.
8,689,804 B2 4/2014 Fernando et al.
(Continued)

FOREIGN PATENT DOCUMENTS

CA 2 939 882 A1 11/2015
CN 106455714 A 2/2017
(Continued)

OTHER PUBLICATIONS

International Search Report for PCT/KR2019/014562 dated Feb. 11, 2020 (PCT/ISA/210).
(Continued)

*Primary Examiner* — Phuong K Dinh
(74) *Attorney, Agent, or Firm* — Sughrue Mion, PLLC

(57) ABSTRACT

According to an embodiment, there is provided an aerosol generating apparatus including a case into which a cigarette including an electromagnetic inductor is insertable, a heating unit configured to heat the cigarette, a detector that includes a coil and measures a current characteristic value of a current flowing through the coil according to predetermined time information, and a controller that controls operation of the heating unit by comparing the current characteristic value measured by the detector with a predetermined reference current characteristic value, wherein the reference current characteristic value is set based on at least one current characteristic value measured by the detector.

15 Claims, 27 Drawing Sheets

(51) Int. Cl.
*A24F 40/465* (2020.01)
*A24F 40/57* (2020.01)

(58) Field of Classification Search
USPC ..... 131/328–329
See application file for complete search history.

(56) References Cited

U.S. PATENT DOCUMENTS

| | | | | |
|---|---|---|---|---|
| 10,159,283 | B2 | 12/2018 | Mironov | |
| 10,959,463 | B2 | 3/2021 | Mironov | |
| 11,064,739 | B2 * | 7/2021 | Gimkiewicz | A24F 40/40 |
| 2017/0095003 | A1 | 4/2017 | Mironov | |
| 2017/0135404 | A1 | 5/2017 | Reevell | |
| 2017/0238610 | A1 | 8/2017 | Reevell | |
| 2019/0059448 | A1 | 2/2019 | Talon | |
| 2019/0261682 | A1 | 8/2019 | Gimkiewicz et al. | |
| 2019/0289908 | A1 * | 9/2019 | Worm | A24F 40/46 |
| 2019/0313698 | A1 | 10/2019 | Kuczaj | |
| 2020/0163384 | A1 * | 5/2020 | Rossoll | H05B 6/10 |
| 2021/0015160 | A1 * | 1/2021 | Moloney | A24F 40/51 |

FOREIGN PATENT DOCUMENTS

| | | | |
|---|---|---|---|
| JP | H11-44760 | A | 2/1999 |
| JP | 2001-521124 | A | 11/2001 |
| JP | 2011-185846 | A | 9/2011 |
| JP | 2012-513750 | A | 6/2012 |
| JP | 2017-515488 | A | 6/2017 |
| KR | 10-2015-0102924 | A | 9/2015 |
| KR | 10-2017-0007262 | A | 1/2017 |
| KR | 10-1792905 | B1 | 11/2017 |
| KR | 10-2018-0033141 | A | 4/2018 |
| KR | 10-2018-0115681 | A | 10/2018 |
| WO | 2018/178113 | A2 | 10/2018 |

OTHER PUBLICATIONS

Tao Wang, "Circuit Analysis Experimental Curriculum", Beijing University of Communications and Communications Publishing House, Jan. 2016, 1st Edition, p. 62 (3 pages total).

Kaihong Xu et al., "Industrial Process Test and Control Technology", Northeast Forestry University Press, Aug. 2016, 2nd Edition, pp. 72-73 (4 pages total).

Joo-pil Nailu Zhang, "Safety Sensing Technology", Seo Safety Science Technical College Press, Aug. 2018, 3rd Edition, pp. 73-74 (4 pages total).

Office Action dated Dec. 2, 2022 in Chinese Application No. 201980006575.5.

Extended European Search Report dated Apr. 20, 2022 in European Application No. 19887193.1.

Notice of Reasons for Refusal dated May 18, 2021 from the Japanese Patent Office in JP Application No. 2020-536163.

Office Action dated Jul. 5, 2022 from the Japanese Patent Office in JP Application No. 2020-536163.

* cited by examiner (a)

(b)

---- ELECTROMAGNETIC INDUCTION

AEROSOL GENERATING APPARATUS AND OPERATION METHOD OF THE SAME

CROSS REFERENCE TO RELATED APPLICATIONS

This application is a National Stage of International Application No. PCT/KR2019/014562 filed Oct. 31, 2019, claiming priority based on Korean Patent Application No. 10-2018-0146769 filed Nov. 23, 2018.

TECHNICAL FIELD

The disclosure disclosed by the present application relates to an aerosol generating apparatus and an operation method of the same.

BACKGROUND ART

Recently, the demand for alternative methods to overcome the shortcomings of general cigarettes has increased. For example, there is growing demand for a method of generating aerosol by heating an aerosol generating material in cigarettes, rather than by combusting cigarettes. Accordingly, studies on a heating-type cigarette or a heating-type aerosol generating device have been actively conducted.

An aerosol generating apparatus has safety issues because a heating unit may be heated even when a cigarette is not inserted, which may occur due to poor operation, carelessness of a user, and so on, and thus, there are risks such as burns to the skin of a user. Accordingly, there is a need for a method of securing safety of a user by heating a cigarette only when a cigarette suitable for the aerosol generating apparatus is inserted.

DESCRIPTION OF EMBODIMENTS

Technical Problem

According to an embodiment, there may be provided an aerosol generating apparatus and an operation method of the same for detecting that a cigarette is inserted into the aerosol generating apparatus through a plurality of detectors using electromagnetic induction.

According to an embodiment, there may be provided an aerosol generating apparatus and an operation method of the same for detecting whether a cover is coupled to a case by using electromagnetic induction and controlling a heating operation according to a coupling state of the cover.

Problems to be solved by the present disclosure are not limited to the above-described problems, and undescribed problems will be clearly understood by those skilled in the art from the present specification and the accompanying drawings.

Solution to Problem

According to an embodiment, there is provided an aerosol generating apparatus including a case into which a cigarette including an electromagnetic inductor is insertable, a heating unit configured to heat the cigarette, a detector that includes a coil and measures a current characteristic value of a current flowing through the coil according to predetermined time information, and a controller that controls operation of the heating unit by comparing the current characteristic value measured by the detector with a predetermined reference current characteristic value, wherein the reference current characteristic value is set based on at least one current characteristic value measured by the detector.

The controller may update the reference current characteristic value based on a first current characteristic value and a second current characteristic value which are measured consecutively by the detector.

When the first current characteristic value measured by the detector and the second current characteristic value measured consecutively with the first current characteristic value are within a predetermined range, the controller may update the reference current characteristic value based on the first current characteristic value and the second current characteristic value.

The aerosol generating apparatus may further includes a temperature sensor that measures a temperature value of the detector, and when a value of difference between the temperature value of the detector and a predetermined reference temperature value is greater than or equal to a predetermined difference value, the controller may update the reference current characteristic value based on the first current characteristic value and the second current characteristic value measured consecutively with the first current characteristic value.

The reference temperature value may be a temperature value measured at a point in time when the reference current characteristic value is set.

If a difference between the current characteristic value measured by the detector and the reference current characteristic value is greater than or equal to a predetermined difference value, the controller may control the heating unit to operate.

The current characteristic value may include at least one of an inductance value of the coil and a frequency value of the current flowing through the coil.

According to another embodiment, there is provided an aerosol generating apparatus including a case into which a cigarette including an electromagnetic inductor is insertable, a heating unit configured to heat the cigarette, a detector that includes a coil and measures a current characteristic value of a current flowing through the coil according to predetermined time information, and a controller that controls operation of the heating unit by comparing a first current characteristic value measured by the detector with a second current characteristic value measured before the first current characteristic value.

The second current characteristic value may be a current characteristic value measured consecutively with the first current characteristic value.

If a difference between the first current characteristic value and the second current characteristic value is greater than or equal to a predetermined difference value, the controller may control the heating unit to operate.

The current characteristic value may include at least one of an inductance value of the coil and a frequency value of the current flowing through the coil.

According to another embodiment, there is provided an aerosol generating apparatus including a case into which a cigarette including an electromagnetic inductor is insertable, a heating unit capable of heating the cigarette, a detector that includes a coil and measures a current characteristic value of a current flowing through the coil according to a predetermined period, and a controller that obtains the amount of a change in current characteristic values measured by the detector and controls operation of the heating unit based on a cumulative value of the amount of change.

If the cumulative value is greater than or equal to a predetermined reference cumulative value, the controller may control the heating unit to operate.

If a predetermined time elapses, the controller may initialize the cumulative value.

If the cumulative value is greater than or equal to a predetermined reference cumulative value, the controller may initialize the cumulative value.

According to another embodiment, there is provided an operation method of an aerosol generating apparatus including a step of measuring a current characteristic value that changes as a cigarette including an electromagnetic inductor is inserted into a case according to a predetermined period, a step of setting a reference current characteristic value based on at least one current characteristic value, and a step of controlling operation of a heating unit based on a current characteristic value measured by the detector and a predetermined reference current characteristic value.

According to another embodiment, there is provided an operation method of an aerosol generating apparatus including a step of measuring a current characteristic value that changes as a cigarette including an electromagnetic inductor is inserted into a case according to a predetermined period, and a step of controlling operation of a heating unit by comparing a first current characteristic value and a second current characteristic value measured before the first current characteristic value.

According to another embodiment, there is provided an operation method of an aerosol generating apparatus including a step of measuring a current characteristic value that changes as a cigarette including an electromagnetic inductor is inserted into a case according to a predetermined period, a step of obtaining the amount of a change in the measured current characteristic values, a step of obtaining a cumulative value of the amount of the change, and a step of controlling operation of a heating unit based on the cumulative value.

According to another embodiment, there is provided an aerosol generating apparatus including a case, a first detector that includes a first coil and detects a current characteristic value of a current which flows through the first coil and changes as a cigarette including an electromagnetic inductor is inserted into the case, a second detector that is located at an upper side of the first detector, includes a second coil, and detects a current characteristic value of a current which flows through the second coil and changes as the cigarette is inserted into the case, a heating unit that heats an aerosol generating material included in the cigarette, and a controller that controls operation of the heating unit based on a change in a current detected by the first detector and a change in a current detected by the second detector.

The cigarette may be inserted in the case in a vertical direction.

When the cigarette is inserted into the case, the electromagnetic inductor may have a predetermined length in a vertical direction.

If the current characteristic value detected by the first detector is within a predetermined first range and the current characteristic value detected by the second detector is within a predetermined second range, the controller may control the heating unit to operate.

The current characteristic value may include at least one of an inductance value of the coil and a frequency value of the current flowing through the coil.

The means for solving the problems of the present disclosure are not limited to the above-described solving means, and the solving means not described will be clearly understood by those skilled in the art from the present specification and the accompanying drawings.

Advantageous Effects of Disclosure

According to an embodiment, by identifying a type of an inserted cigarette and only heating a predetermined cigarette, safety may be secured and smoking satisfaction may be increased.

In addition, according to an embodiment, by controlling a heating operation based on whether the cover is coupled to a case, a user may be prevented from being burnt due to a heated portion.

In addition, according to an embodiment, by controlling the heating operation based on whether the cover is coupled to the case and whether a cigarette is inserted into the case, wasteful heating is prevented and power consumption is reduced.

Effects of the present disclosure are not limited to the above-described effects, and effects not described will be clearly understood by those skilled in the art in which the present disclosure is involved from the present specification and the accompanying drawings.

BEST MODE

Figure 1:
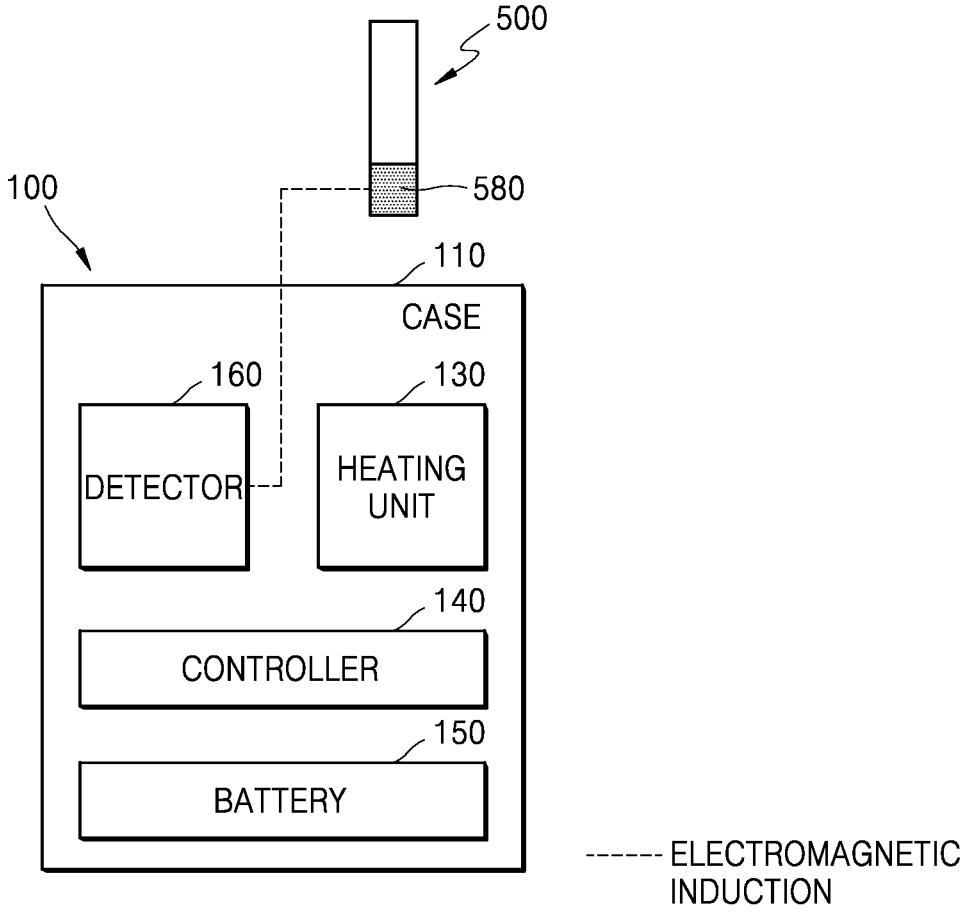
FIGS. 1 and 2 are block configuration diagrams illustrating embodiments of an aerosol generating apparatus.

According to one embodiment, there is provided an aerosol generating apparatus including a case into which a cigarette including an electromagnetic inductor is insertable, a heating unit capable of heating the cigarette, a detector that includes a coil and measures a current characteristic value of a current flowing through the coil according to a predetermined period, and a controller that controls operation of the heating unit by comparing the current characteristic value measured by the detector with a predetermined reference current characteristic value, wherein the reference current characteristic value is set based on at least one current characteristic value measured by the detector.

According to another embodiment, there is provided an aerosol generating apparatus including a case into which a cigarette including an electromagnetic inductor is insertable, a heating unit capable of heating the cigarette, a detector that includes a coil and measures a current characteristic value of a current flowing through the coil according to a predetermined period, and a controller that controls operation of the heating unit by comparing a first current characteristic value measured by the detector with a second current characteristic value measured before the first current characteristic value.

According to another embodiment, there is provided an aerosol generating apparatus including a case into which a cigarette including an electromagnetic inductor is insertable, a heating unit capable of heating the cigarette, a detector that includes a coil and measures a current characteristic value of a current flowing through the coil according to a predetermined period, and a controller that obtains the amount of change in current characteristic values measured by the detector and controls operation of the heating unit based on a cumulative value of the amount of change.

According to another embodiment, there is provided an operation method of an aerosol generating apparatus including a step of measuring a current characteristic value that changes as a cigarette including an electromagnetic inductor is inserted into a case according to a predetermined period, a step of setting a reference current characteristic value based on at least one current characteristic value, and a step of controlling operation of a heating unit based on a current characteristic value measured by the detector and a predetermined reference current characteristic value.

According to another embodiment, there is provided an operation method of an aerosol generating apparatus including a step of measuring a current characteristic value that changes as a cigarette including an electromagnetic inductor is inserted into a case according to a predetermined period, and a step of controlling operation of a heating unit by comparing a measured first current characteristic value and a second current characteristic value measured before the first current characteristic value.

According to another embodiment, there is provided an operation method of an aerosol generating apparatus including a step of measuring a current characteristic value that changes as a cigarette including an electromagnetic inductor is inserted into a case according to a predetermined period, a step of obtaining the amount of change in the measured current characteristic values, a step of obtaining a cumulative value of the amount of amount, and a step of controlling operation of a heating unit based on the cumulative value.

According to another embodiment, there is provided an aerosol generating apparatus including a case, a first detector that includes a first coil and detects a current characteristic value of a current which flows through the first coil and changes as a cigarette including an electromagnetic inductor is inserted into the case, a second detector that is located at an upper side of the first detector, includes a second coil, and detects a current characteristic value of a current which flows through the second coil and changes as the cigarette is inserted into the case, a heating unit that heats an aerosol generating material included in the cigarette, and a controller that controls operation of the heating unit based on a change in a current detected by the first detector and a change in a current detected by the second detector.

MODE OF DISCLOSURE

With respect to the terms used to describe the various embodiments, general terms which are currently and widely used are selected in consideration of functions of structural elements in the various embodiments of the present disclosure. However, meanings of the terms can be changed according to intention, a judicial precedence, the appearance of new technology, and the like. In addition, in certain cases, a term which is not commonly used can be selected. In such a case, the meaning of the term will be described in detail at the corresponding portion in the description of the present disclosure. Therefore, the terms used in the various embodiments of the present disclosure should be defined based on the meanings of the terms and the descriptions provided herein.

In addition, unless explicitly described to the contrary, the word "comprise" and variations such as "comprises" or "comprising" will be understood to imply the inclusion of stated elements but not the exclusion of any other elements. In addition, the terms "-er", "-or", and "module" described in the specification mean units for processing at least one function and operation and can be implemented by hardware components or software components and combinations thereof.

Hereinafter, the present disclosure will now be described more fully with reference to the accompanying drawings, in which exemplary embodiments of the present disclosure are shown such that one of ordinary skill in the art may easily work the present disclosure. The disclosure may, however, be embodied in many different forms and should not be construed as being limited to the embodiments set forth herein.

Throughout the specification, an aerosol generating device may be a device that generates aerosol by using an aerosol generating material to generate aerosol that may be directly puffed into lungs of a user through a mouth of the user. For example, the aerosol generating device may be a holder.

In the specification, a term "puff" refers to inhalation of the user, and the inhalation may mean an act of pulling into the oral cavity, the nasal cavity, or lungs of a user through the mouth or the nose of the user.

Hereinafter, the present disclosure will now be described more fully with reference to the accompanying drawings, in which exemplary embodiments of the present disclosure are shown such that one of ordinary skill in the art may easily work the present disclosure. The disclosure may, however, be embodied in many different forms and should not be construed as being limited to the embodiments set forth herein.

Hereinafter, embodiments of the present disclosure will be described in detail with reference to the drawings.

Figure 2:
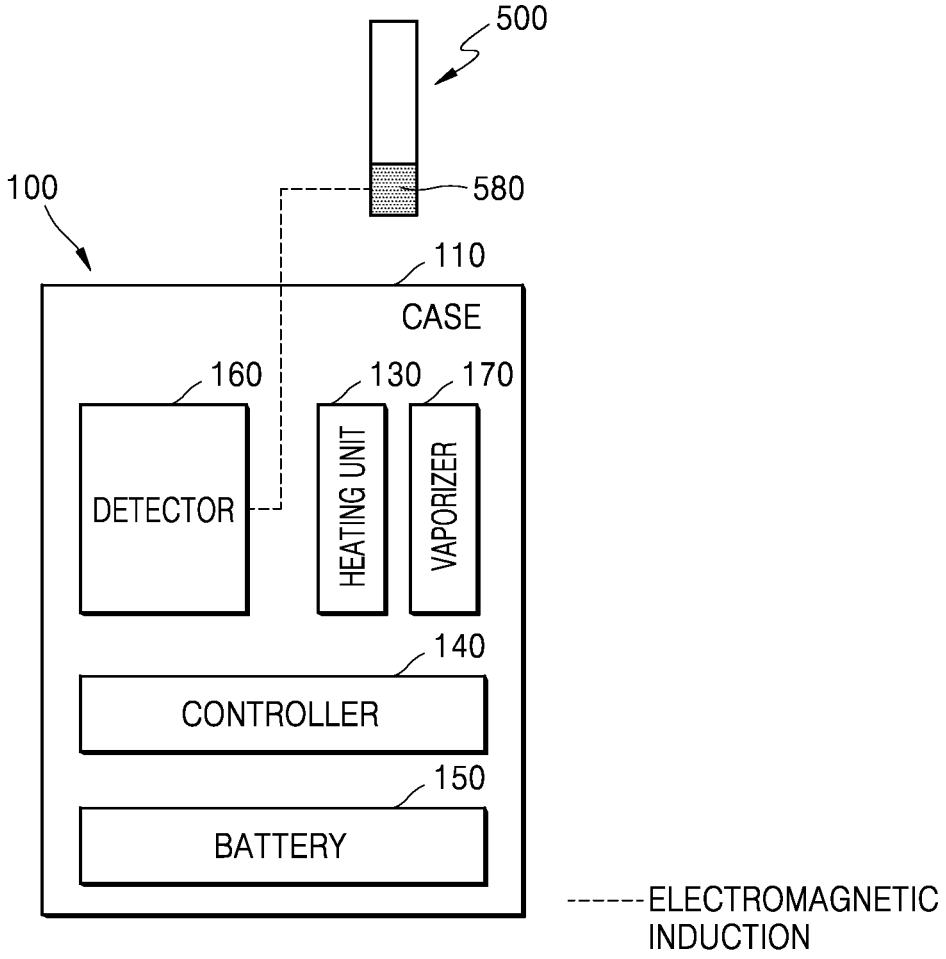

FIGS. 1 and 2 are block configuration diagrams illustrating embodiments of an aerosol generating apparatus.

Referring to FIG. 1, an aerosol generating apparatus 100 may include a case 110, a heating unit 130, a detector 160, a battery 150, and a controller 140. Referring to FIG. 2, the aerosol generating apparatus 100 may further include a vaporizer 170. In addition, a cigarette 500 may include an electromagnetic inductor 580. The cigarette 500 may be inserted into an inner space of the aerosol generating apparatus 100.

FIGS. 1 and 2 illustrate components of the aerosol generating device 100, which are related to the present embodiment. Therefore, it will be understood by one of ordinary skill in the art related to the present embodiment that other general-purpose components may be further included in the aerosol generating device 100, in addition to the components illustrated in FIGS. 1 through 3.

FIG. 1 illustrates that the battery 150, the controller 140, and the heater 130 are arranged in series. Also, FIG. 2 illustrates that the battery 150, the controller 140, the vaporizer 170, and the heater 130 are arranged in series. However, the internal structure of the aerosol generating device 100 is not limited to the structures illustrated in FIGS. 1 through 3. In other words, according to the design of the aerosol generating device 100, the battery 150, the controller 140, the heater 130, and the vaporizer 170 may be differently arranged.

When the cigarette 500 is inserted into the aerosol generating device 100, the aerosol generating device 100 may operate the heater 130 and/or the vaporizer 170 to generate aerosol from the cigarette 500 and/or the vaporizer 170. The aerosol generated by the heater 130 and/or the vaporizer 170 is delivered to a user by passing through the cigarette 500.

As necessary, the aerosol generating apparatus 100 may heat the heating unit 130 while the cigarette 500 is not inserted into the aerosol generating apparatus 100.

The case 110 forms a part of the exterior of the aerosol generating apparatus 100 and functions to accommodate and protect various elements therein.

The heating unit 130 is heated by an electric power supplied from the battery 150, thereby, heating and vaporizing an aerosol generating material. However, the heater 130 is not limited to the example described above and may include any heaters which may be heated to a desired temperature. Here, the desired temperature may be pre-set in the aerosol generating device 100 or may be set by a user.

The heating unit 130 may be located inside or outside the cigarette 500 to heat the aerosol generating material.

The heater 130 may include an electro-resistive heater. For example, the heater 130 may include an electrically conductive track, and the heater 130 may be heated when currents flow through the electrically conductive track.

As another example, the heater 130 may include an induction heater. In detail, the heater 130 may include an electrically conductive coil for heating a cigarette by an induction heating method, and the cigarette may include a susceptor which may be heated by the induction heater.

In addition, the shape of the heater 130 is not limited to the shapes illustrated in FIGS. 1 and 2 and may include various shapes. For example, the heater 130 may include a tube-type heating element, a plate-type heating element, a needle-type heating element, or a rod-type heating element, and may heat the inside or the outside of the cigarette 500, according to the shape of the heating element.

Also, the aerosol generating device 100 may include a plurality of heaters 130. Here, the plurality of heaters 130 may be inserted into the cigarette 500 or may be arranged outside the cigarette 500. Also, some of the plurality of heaters 130 may be inserted into the cigarette 500 and the others may be arranged outside the cigarette 500.

The detector 160 may detect whether the cigarette 500 is inserted into the aerosol generating apparatus 100. The detector 160 may include a coil. Moreover, the cigarette 500 may include an electromagnetic inductor 580. As the cigarette 500 is inserted into or separated from the case 110, electromagnetic induction may occur between the coil and the electromagnetic inductor 580. At this time, the detector 160 may detect a change in characteristics of a current flowing through the coil, which is caused by the electromagnetic induction.

Although only one detector 160 is illustrated in FIGS. 1 and 2, according to one embodiment, two or more detectors 160 may be arranged. A plurality of detectors 160 may detect an insertion state of the cigarette 500 at different locations. The plurality of detectors 160 may be arranged to be spaced apart from each other in a vertical direction.

The cigarette 500 may include the electromagnetic inductor 580. An eddy current may be induced by the detector 160 and flow on the electromagnetic inductor 580. The detector 160 may detect the eddy current induced in the coil of the detector 160 again by the electromagnetic inductor 580.

A method of detecting a change in characteristics of the current flowing through the coil due to electromagnetic induction by using the detector 160 detects may vary. According to one embodiment, an alternating current may be applied to the coil, and the alternating current may induce an eddy current in the electromagnetic inductor 580. The eddy current flowing through the electromagnetic inductor 580 may induce a change in the current flowing through the coil by mutual induction with the coil again. The detector 160 may detect a change in the current flowing through the coil.

According to another embodiment, the detector 160 may include a transmission coil through which an alternating current flows and which induces an eddy current in the electromagnetic inductor 580, and a detection coil that detects an eddy current flowing through the electromagnetic inductor 580. At this time, the transmission coil and the detection coil may be arranged in a vertical direction, and thus, interference between the transmission coil and the detection coil may be minimized. The method of detecting a mutual induction phenomenon occurring between the coil and the electromagnetic inductor 580 may be performed in various ways and is not limited to the above-described example.

Detecting a change in characteristics of a current due to an electromagnetic induction by using the detector 160 may include not only directly measuring a current by using an ammeter but also detecting a current by an indirect method. For example, those skilled in the art may understand that the detector 160 may detect a current change by measuring the induced electromotive force induced in a coil in the form of a voltage.

The vaporizer 170 may generate aerosol by heating a liquid composition and the generated aerosol may pass through the cigarette 500 to be delivered to a user. In other words, the aerosol generated via the vaporizer 170 may move along an air flow passage of the aerosol generating device 100 and the air flow passage may be configured such that the aerosol generated via the vaporizer 170 passes through the cigarette 500 to be delivered to the user. The vaporizer 170 may generate aerosol by heating the liquid composition, and discharge the aerosol toward the cigarette 500 so that the aerosol passes through the cigarette 500 inserted into a cigarette insertion portion.

For example, the vaporizer 170 may include a liquid storage, a liquid delivery element, and a heating element, but it is not limited thereto. For example, the liquid storage, the liquid delivery element, and the heating element may be included in the aerosol generating device 100 as independent modules.

The liquid storage may store a liquid composition. For example, the liquid composition may be a liquid including a tobacco-containing material having a volatile tobacco flavor component, or a liquid including a non-tobacco material. The liquid storage may be formed to be detachable from the vaporizer 170 or may be formed integrally with the vaporizer 170.

For example, the liquid composition may include water, a solvent, ethanol, plant extract, spices, flavorings, or a vitamin mixture. The spices may include menthol, peppermint, spearmint oil, and various fruit-flavored ingredients, but are not limited thereto. The flavorings may include ingredients capable of providing various flavors or tastes to a user. Vitamin mixtures may be a mixture of at least one of vitamin A, vitamin B, vitamin C, and vitamin E, but are not limited thereto. Also, the liquid composition may include an aerosol forming substance, such as glycerin and propylene glycol.

The liquid delivery element may deliver the liquid composition of the liquid storage to the heating element. For example, the liquid delivery element may be a wick such as cotton fiber, ceramic fiber, glass fiber, or porous ceramic, but is not limited thereto.

The heating element is an element for heating the liquid composition delivered by the liquid delivery element. For example, the heating element may be a metal heating wire, a metal hot plate, a ceramic heater, or the like, but is not limited thereto. In addition, the heating element may include a conductive filament such as nichrome wire and may be positioned as being wound around the liquid delivery element. The heating element may be heated by a current supply and may transfer heat to the liquid composition in contact with the heating element, thereby heating the liquid composition. As a result, aerosol may be generated.

For example, the vaporizer 170 may be referred to as a cartomizer or an atomizer, but it is not limited thereto.

The aerosol generating apparatus 100 may include a memory (not illustrated). The memory may store information necessary for operation of the aerosol generating apparatus 100, and the controller may control the aerosol generating apparatus 100 with reference to the memory.

The memory may store, in advance, information on the type of the cigarette 500 according to a current characteristic value, information on control scenario of the heating unit 130 according to the type of the cigarette 500, and so on.

In addition, the memory may temporarily store information detected in real time during the operation of the aerosol generating apparatus 100. The memory temporarily stores current characteristic value information detected by the detector 160, calculation result information using a current characteristic value, and so on so that the controller may refer to the information.

The battery 150 supplies power used to operate the aerosol generating apparatus 100. For example, the battery 150 may supply power to heat the heating unit 130, and supply power necessary for the controller 140 to operate. The battery 150 may supply power to operate the detector 160. In addition, the battery 150 may supply power necessary for a display, a sensor, a motor, and so on installed in the aerosol generating apparatus 100 to operate.

According to one embodiment, the battery 150 may be electrically connected to an adapter, and the adapter may convert a direct current output from the battery 150 into an alternating current.

The controller 140 may generally control operations of the aerosol generating device 100. In detail, the controller 140 may control not only operations of the battery 150, the heater 130, and the detector 160, but also operations of other components included in the aerosol generating device 100.

The controller 140 may control operation of the detector 160. The controller 140 may differently adjust a frequency of the alternating current applied to the detector 160, a magnitude of the current, and so on.

The controller 140 may determine whether or not the electromagnetic inductor 580 is close to the coil based on a change in characteristics of a current flowing through the coil, which is detected by the detector 160. In other words, the controller 140 may determine whether the cigarette 500 provided with the electromagnetic inductor 580 is inserted into the case 110 or separated therefrom.

The controller 140 may include at least one processor. A processor can be implemented as an array of a plurality of logic gates or can be implemented as a combination of a general-purpose microprocessor and a memory in which a program executable in the microprocessor is stored. It will be understood by one of ordinary skill in the art that the processor can be implemented in other forms of hardware.

The aerosol generating device 100 may further include general-purpose components in addition to the battery 150, the controller 140, the heater 130, and the detector 160. For example, the aerosol generating device 100 may include a display capable of outputting visual information, a motor for outputting haptic information and/or a charging contact for charging the battery 150. For example, a motor is capable of informing the user via vibration that the heating operation of the heater 130 has completed. For example, the aerosol generating device 100 may comprises at least one LED, and is capable of indicating the operation status of the heater 130 via the LED.

Also, the aerosol generating device 100 may include at least one sensor (a puff detecting sensor, a temperature detecting sensor, a cigarette insertion detecting sensor, etc.). The controller 140 may check the presence or absence of puff of a user and strength of the puff through the puff detection sensor, and count the number of puffs.

In addition, the aerosol generating apparatus 100 may include an input unit (not illustrated). As the input unit receives a user input, the operation of the aerosol generating apparatus 100 may be controlled.

Figure 3:
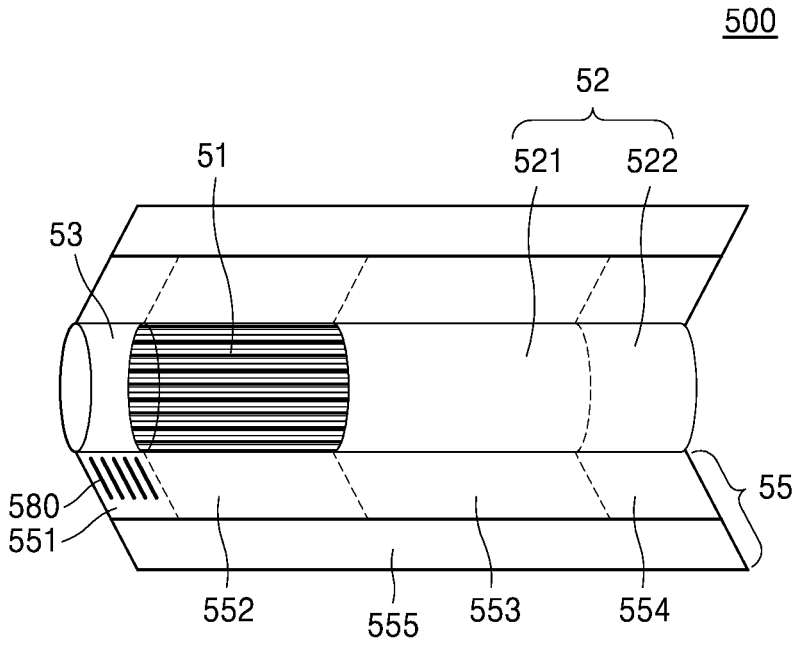
FIG. 3 is a view illustrating a state in which a cigarette is inserted into an aerosol generating apparatus.

FIG. 3 is a perspective view of a cigarette.

Since items described with reference to FIG. 3 are only one embodiment of the cigarette 500, the cigarette 500 used in the aerosol generating apparatus 100 is not limited thereto.

The cigarette 500 may include a tobacco rod 51 and a filter rod 52. The tobacco rod 51 includes a tobacco material and an aerosol generating material. The tobacco material may be tobacco.

The filter rod 52 includes a single segment or a plurality of segments. For example, the filter rod 52 may include a first segment 521 configured to cool aerosol and a second segment 522 configured to filter a certain component included in the aerosol.

In addition, the cigarette 500 may further include a front end plug 53. The front end plug 53 may be located on one side of the tobacco rod 51, the side not facing the filter rod 52. The front end plug 53 may prevent the tobacco rod 51 from escaping to the outside, and prevent aerosol liquefied from the tobacco rod 51 during smoking from flowing into the aerosol generating apparatus (1 of FIGS. 1 to 3). The cigarette 500 may not include the front end plug 53.

The cigarette 500 may be packaged by at least one wrapper 55. For example, the front end plug 53 may be packaged by a first wrapper 551, the tobacco rod 51 may be packaged by a second wrapper 552, the first segment 521 may be packaged by a third wrapper 553, and the second segment 522 may be packaged by a fourth wrapper 554. The entire cigarette 500 may be packaged by a fifth wrapper 555.

A diameter of the cigarette 500 may be within a range from 5 mm to 9 mm, and a length thereof may be approximately 48 mm, but is not limited thereto. For example, a length of the front end plug 53 is approximately 7 mm, a length of the tobacco rod 51 is approximately 15 mm, a length of the first segment 521 is approximately 12 mm, and a length of the second segment 522 is approximately 14 mm, but an embodiment is not limited thereto.

For example, the aerosol generating material may include at least one of glycerin, propylene glycol, ethylene glycol, dipropylene glycol, diethylene glycol, triethylene glycol, tetraethylene glycol, and oleyl alcohol, but it is not limited thereto. Also, the tobacco rod 51 may include other additives, such as flavors, a wetting agent, and/or organic acid. Also, the tobacco rod 51 may include a flavored liquid, such as menthol or a moisturizer, which is injected to the tobacco rod 51.

The cigarette 500 may include the electromagnetic inductor 580.

The electromagnetic inductor 580 may include a conductor capable of inducing an eddy current, a magnetic body capable of generating a change in magnetic flux, and so on. For example, the electromagnetic inductor 580 may include a metallic material, magnetic ink, a magnetic tape, or so on. For example, the electromagnetic inductor 580 may be an aluminum foil. In addition to this, the electromagnetic inductor 580 may include, without limitation, materials that may be detected by causing a change in magnetic flux in the coil of the detector 160.

The electromagnetic inductor 580 may wrap contents of the cigarette 500 along a perimeter of the cigarette 500. The electromagnetic inductor 580 may be wrapped by a wrapper 55 in a state in which one surface of a metal foil faces and overlaps an inner surface of the wrapper 55.

A location where the electromagnetic inductor 580 is provided in the cigarette 500 may change.

For example, the electromagnetic inductor 580 may be disposed in a region corresponding to the front end plug 53. Here, the cigarette 500 is inserted into the aerosol generating apparatus 100 in a direction in which the front end plug 53 faces the aerosol generating apparatus 100, and thus, the electromagnetic inductor 580 is immediately inserted into the aerosol generating apparatus 100 when the cigarette 500 starts to be inserted. Thereby, the detector 160 may detect quickly that the cigarette 500 starts to be inserted by detecting an approach of the electromagnetic inductor 580.

In addition, when separating the cigarette 500, the front end plug 53 is separated from the aerosol generating apparatus 100 at the last, and thus, the detector 160 may detect that the electromagnetic inductor 580 is separated completely by detecting separation of the electromagnetic inductor 580.

For another example, the electromagnetic inductor 580 may wrap the inside of the tobacco rod 51 or the tobacco rod 51 in a state of overlapping the wrapper 55.

Alternatively, the electromagnetic inductor 580 may wrap the inside of the filter rod 52 or the filter rod 52 in a state of overlapping the wrapper 55.

Alternatively, the electromagnetic inductor 580 may be disposed between the segments. Alternatively, the electromagnetic inductor 580 may be disposed at the bottom or top of the cigarette 500.

Figure 4:
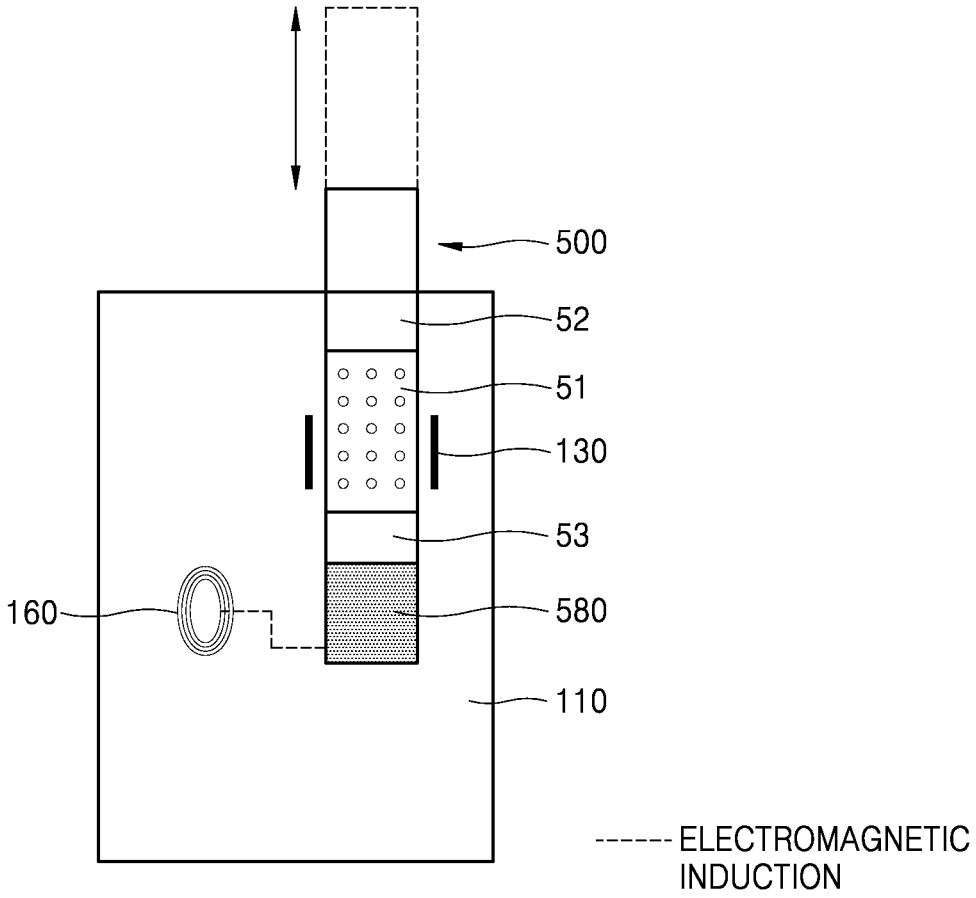
FIG. 4 is a perspective view of a cigarette.

FIG. 4 is a view illustrating a state in which a cigarette is inserted into the aerosol generating apparatus.

Referring to FIG. 4, if the cigarette 500 is inserted into the case 110, the tobacco rod 51 may be disposed in parallel with the heating unit 130, and the front end plug 53 may be disposed in parallel with the detector 160. The tobacco rod 51 may be surrounded by the heating unit 130 to be heated, and the front end plug 53 may approach the detector 160.

As the cigarette 500 is inserted into the case 110, a separation distance between the electromagnetic inductor 580 and the detector 160 may be reduced. The detector 160 may detect a change in characteristics of a current flowing through the coil, which is generated as the electromagnetic inductor 580 approaches thereto. The controller 140 may determine that the cigarette 500 is inserted into the case 110 based on the detected change in characteristics of the current.

In contrast to this, when the cigarette 500 is separated from the case 110, the separation distance between the electromagnetic inductor 580 and the detector 160 may increase, and thus, the detector 160 may detect a change in characteristics of the current flowing through the coil, which is generated thereby. The controller 140 may determine that the cigarette 500 is separated from the case 110 based on the detected change in characteristics of the current.

The aerosol generating apparatus 100 may also identify the type of the inserted cigarette 500. A current characteristic value that the detector 160 detects by using the electromagnetic inductor 580 may change according to a length, a location, and a shape of the electromagnetic inductor 580. The controller may identify the type of the cigarette 500 by identifying the length, the location, and the shape of the electromagnetic inductor 580 based on the current characteristic values respectively received from the detectors 160.

Figure 5:
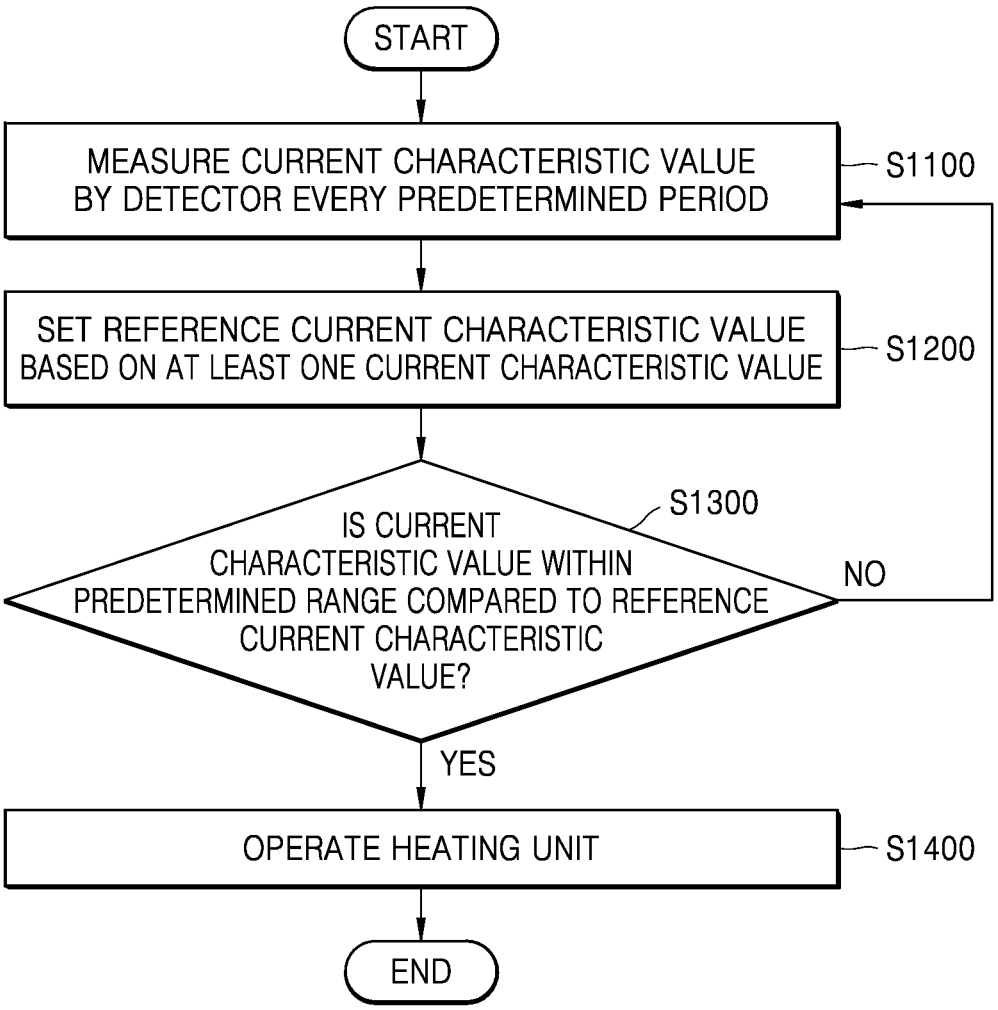
FIG. 5 is a flowchart illustrating a method by which an aerosol generating apparatus operates a heating unit according to an insertion state of a cigarette.

FIG. 5 is a flowchart illustrating a method of operating the heating unit according to an insertion state of a cigarette by using the aerosol generating apparatus.

Referring to FIG. 5, the aerosol generating apparatus 100 may measure a current characteristic value every predetermined period by using the detector 160 (S1100).

The predetermined period may be a time interval at which a current characteristic value is expected to change as the cigarette 500 is inserted, which enables effective detection of the cigarette 500 being inserted in the case 110. For example, the period may be 2 seconds. Alternatively, when the time required for the cigarette 500 to be inserted is usually 1 second, a period may be set to 0.1 second so that the aerosol generating apparatus 100 may measure a current characteristic value 10 times during the insertion of the cigarette 500.

The current characteristic value that the detector 160 detects for the change by using an electromagnetic induction may be diverse. For example, the current characteristic values may include a current value of a current flowing through a coil, a frequency value in a case of an alternating current, a magnitude of a voltage, an inductance value of a coil changed by a current due to a mutual induction, a quality factor of the coil, an effective resistance and an impedance value, and so on. To this end, the detector 160 may further include a frequency measuring element, a rectifier, an amplifier, an oscillation circuit that generates electrical vibration, and so on.

Moreover, the current characteristic values may include physical quantities that may be converted to each other through calculation. For example, after a frequency value is detected, an inductance value of a coil may be obtained through calculation. Accordingly, measuring one current characteristic value includes obtaining another current characteristic value that may be converted by using the measured current characteristic value.

The aerosol generating apparatus 100 may set a reference current characteristic value based on at least one current characteristic value (S1200).

The reference current characteristic value may be a value that becomes a reference for determining an insertion state of the cigarette 500 through comparison with the measured current characteristic value. For example, the reference current characteristic value may be a current characteristic value between a current characteristic value measured when a cigarette is inserted and a current characteristic value measured when the cigarette is separated. For example, the reference current characteristic value may be a reference frequency value or a reference inductance value which will be described below through FIG. 6. The reference current characteristic value may include a minimum value and/or a maximum value, which define a predetermined range.

The reference current characteristic value may be updated and changed based on the measured current characteristic value. The reference current characteristic value may be updated by reflecting an external factor.

For example, when the ambient temperature rises, the measured current characteristic value may increase or decrease according to temperature rise. Accordingly, there may be an increase or a decrease in a current characteristic value measured when a cigarette is inserted and when the cigarette is separated. The reference current characteristic value may be updated to increase or decrease based on the measured current characteristic value reflecting an influence of the temperature rise. Thus, the reference current characteristic value may be maintained between a value for a cigarette insertion state and a value for a cigarette separation state even when the ambient temperature rises.

For example, the reference current characteristic value may be various values obtained from the current characteristic values such as, arithmetic mean, geometric mean, or harmonic mean of measured current characteristic values, a minimum or maximum value of the measured current characteristic values, the nth largest value of the measured current characteristic values, and so on.

The aerosol generating apparatus 100 may determine whether the current characteristic value is within a predetermined range based on comparison with the reference current characteristic value (S1300).

The aerosol generating apparatus 100 may determine that the cigarette 500 is inserted when the detected current characteristic value is within a predetermined range defined by the reference current characteristic value. The predetermined range will be described below in more detail with reference to FIG. 6.

The aerosol generating apparatus 100 may operate the heating unit 130 (S1400).

The aerosol generating apparatus 100 may operate the heating unit 130 when it is determined that the cigarette 500 is inserted into the case 110 based on the current characteristic value. Here, meaning of operating the heating unit 130 may include not only immediately heating the heating unit 130, but also allowing the heating unit 130 to operate.

By contrast, when the cigarette 500 is not inserted into the case 110, the aerosol generating apparatus 100 may not operate the heating unit 130. For example, when the cigarette 500 is not inserted into the case 110, the aerosol generating apparatus 100 may not start a heating operation even if a user input for smoking is received. In addition, for example, the aerosol generating apparatus 100 may stop operation of the heating unit 130 when the cigarette 500 is separated from the case 110 during the operation of the heating unit 130.

Figure 6:
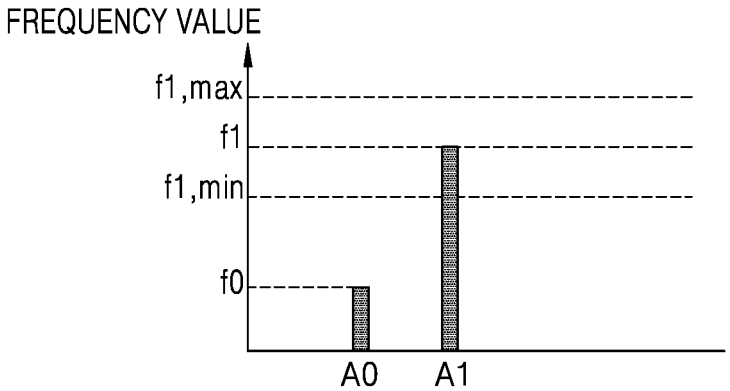
FIG. 6 is a graph of current characteristic values detected by an aerosol generating apparatus.
Figure 6:
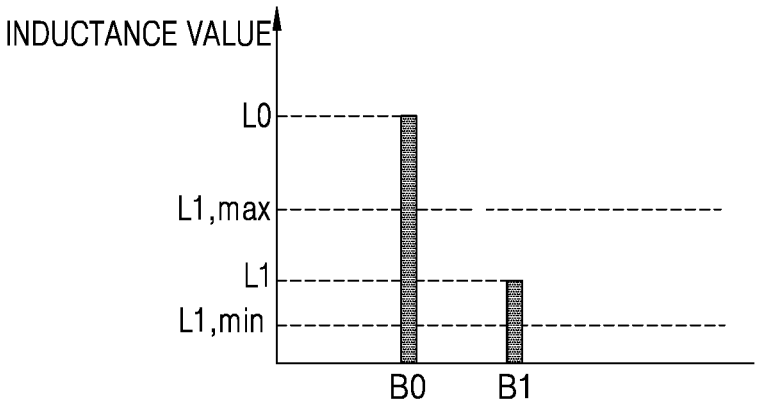

FIG. 6 is a graph of the current characteristic values detected by the aerosol generating apparatus.

Frequency values and inductance values of the coil among various current characteristic values that may be detected by the aerosol generating apparatus 100 will be described with reference to FIG. 6 as an example. Contents which will be described below are not limited to the frequency values and the inductance values, and may be applied to other current characteristic values to the extent that the degree of a change in the current characteristic value is detected and compared with the reference value.

An inductance L of the coil may be obtained by, for example, Equation 1.

$$L = \frac{1}{(2\pi * Fsen)^C} \quad \text{[Equation 1]}$$

Here, Fsen means a frequency of a current flowing through the coil, and C means a capacitance of the coil. A capacitance C of the coil may be a value reflecting the capacitance of the coil itself and a parasitic capacitance.

Referring to FIG. 6 (*a*), the controller 140 may previously set a minimum reference frequency value (f1,min) and a maximum reference frequency value (f1,max). When a frequency value of the signal measured by the detector 160 is greater than the minimum reference frequency value (f1,min) and is less than the maximum reference frequency value (f1,max), the controller 140 may recognize that the cigarette 500 is inserted or a specific type of the cigarette 500 is inserted.

For example, when the detector 160 detects a signal A0, the controller 140 may determine that the cigarette 500 is not inserted because a frequency value f0 of the signal A0 is less than the minimum reference frequency value (f1,min).

The minimum reference frequency value (f1,min) and the maximum reference frequency value (f1,max) may be set in consideration of a basic signal generated when a current applied to the coil by the controller 140 is influenced by a metallic material or the like of the case 110. Since the basic signal may continuously influence the detector 160 regardless of an insertion state of the cigarette 500, the controller 140 may recognize the insertion state of the cigarette 500 and the type of the inserted cigarette 500 in consideration of presence of the basic signal.

The minimum reference frequency value (f1,min) may be set to a value greater than or equal to the frequency of the basic signal, but less than the frequency of the signal when the cigarette 500 is inserted.

In the example described above, the frequency value of the signal is greater than the frequency value of the basic signal when the cigarette 500 is inserted, but according to another embodiment, when the cigarette 500 is inserted, the frequency value of the signal may be measured to be less than the frequency value of the basic signal according to a shape and disposition of the detector 160, a shape of disposition of the electromagnetic inductor 580, and so on.

Referring to FIG. 6 (*b*), the controller 140 may previously set a minimum reference inductance value (L1,min) and a maximum reference inductance value (L1,max).

An inductance value may be obtained through calculation from the frequency value. The inductance value may change according to approach of the electromagnetic inductor 580, and a tendency of the change may be opposite to a tendency of the change of the frequency value. For example, when the electromagnetic inductor 580 approaches, the frequency value may increase while the inductance value may decrease.

When an inductance value L1 of the coil changing according to the signal B1 measured by the detector 160 is greater than or equal to the minimum reference inductance value (L1,min) and is less than the maximum reference inductance value (L1,max), the controller 140 may recognize that the cigarette 500 is inserted, or a specific type of cigarette 500 is inserted.

Alternatively, when the detector 160 detects the signal B0, the inductance value L0 changing according to the signal B0 is greater than or equal to the maximum reference inductance value (L1,max), and thus, the controller 140 may determine that the cigarette 500 is not inserted.

The minimum reference frequency value (L1,min) and the maximum reference frequency value (f1,max) may be set in consideration of the basic signal generated when the current applied to the coil by the controller 140 is influenced by a metallic material or the like of the case 110.

Of course, unlike the example described above, the inductance value may increase according to approach of the electromagnetic inductor 580 according to the shape and disposition of the detector 160, the shape and disposition of the electromagnetic inductor 580, and so on.

Moreover, the controller may correct the reference value in consideration of a temperature of the detector 160.

For example, as the temperature of the detector 160 increases, the frequency value of the basic signal may also increase. Accordingly, in order to minimize an effect of the temperature, the aerosol generating apparatus 100 may correct the minimum reference value and the maximum reference value according to the temperature of the detector 160.

The aerosol generating apparatus 100 may further include a temperature sensor capable of measuring the temperature of the detector 160. The temperature sensor may directly measure a temperature of a coil of the detector 160 or may obtain the temperature of the coil indirectly by measuring a temperature around the detector 160 and performing calculation based on the measured temperature.

Figure 7:
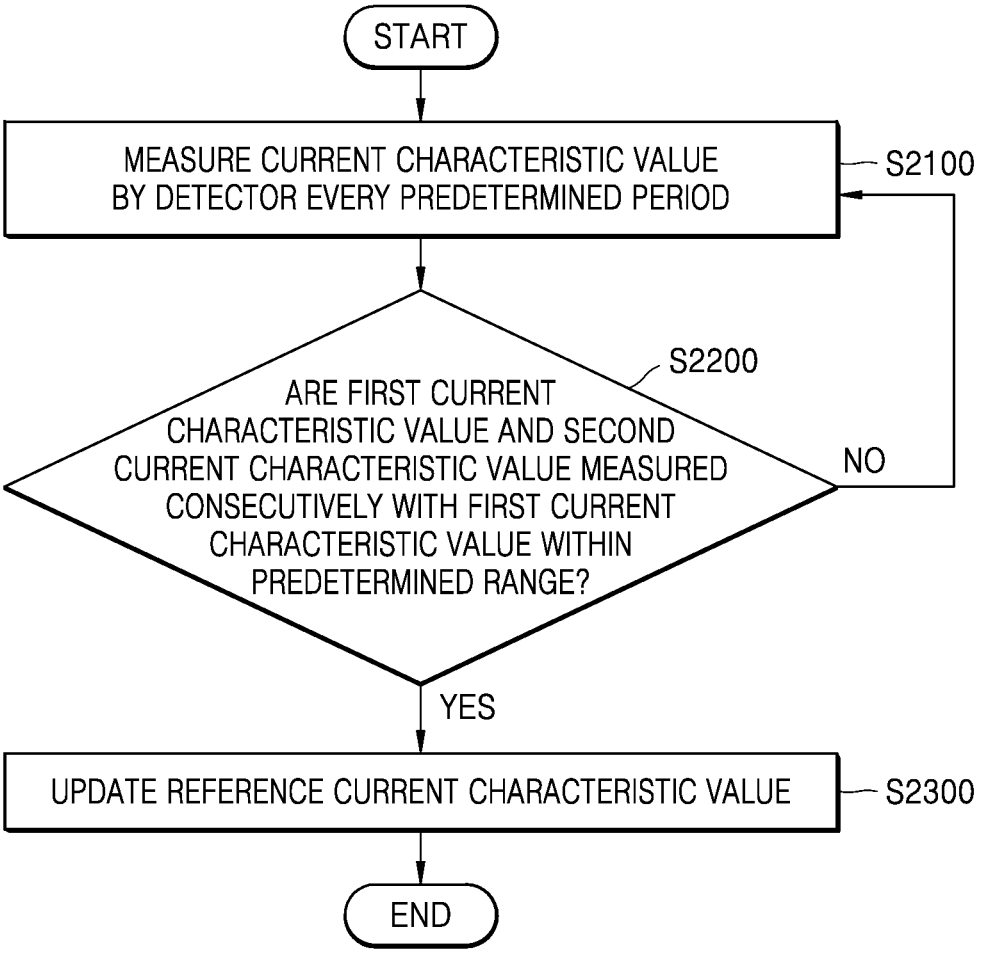
FIG. 7 is a flowchart of an operation method by which an aerosol generating apparatus sets a reference current characteristic value.

FIG. 7 is a flowchart of an operation method by which the aerosol generating apparatus sets a reference current characteristic value.

Referring to FIG. 7, the aerosol generating apparatus 100 may measure a current characteristic value every predetermined period by using the detector 160 (S2100). In step S2100, the contents described in step S1100 may be applied.

It may be determined whether or not a first current characteristic value and a second current characteristic value consecutively measured with the first current characteristic value are within a predetermined range (S2200).

The aerosol generating apparatus 100 may compare current characteristic values which are consecutively measured, among the measured current characteristic values. For the sake of convenience, the first current characteristic value and the second current characteristic value are described, but content relating thereto may also be applied to a third current characteristic value measured consecutively with the second current characteristic value and subsequent current characteristic values measured consecutively. For example, the aerosol generating apparatus 100 may determine whether or not the first current characteristic value to a predetermined nth current characteristic value are within a predetermined range.

The predetermined range is a value which may mean that current characteristic values are measured as the same values or similar values consistently when there is no external stimulus, and may be, for example, deviation, variance, and standard deviation of an average value of respective current characteristic values.

When the first current characteristic value and the second current characteristic value are within the predetermined range, the aerosol generating apparatus 100 may update the reference current characteristic value based on the first current characteristic value and the second current characteristic value. (S2300).

The measured current characteristic values may include a value with a rather low reliability to be used as the reference current characteristic value because an instantaneous error is reflected. Accordingly, the controller may update the reference current characteristic value only when a predetermined condition is satisfied. The predetermined condition may be, for example, that the measured current characteristic values are within a predetermined range.

Thereby, when the measured current characteristic value is stably and consecutively maintained, the controller may update the reference current characteristic value based on the measured current characteristic value.

Figure 8:
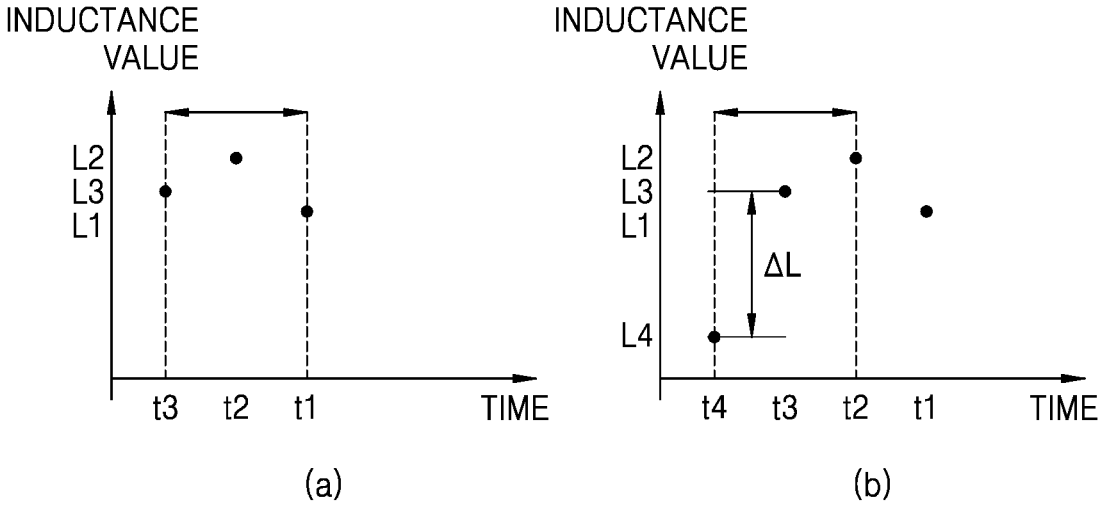
FIG. 8 is a graph of current characteristic values detected by an aerosol generating apparatus.

FIG. 8 is a graph of current characteristic values detected by the aerosol generating apparatus 100.

Referring to FIG. 8, the current characteristic value may be, for example, an inductance value. Contents which will be described below are not limited only to a case where the current characteristic value is an inductance value, and may be applied to various current characteristic values.

In FIG. 8 (*a*), inductance values are measured at a first point in time t1, a second point in time t2, and a third point in time t3 according to a period.

Deviations of the first inductance value L1, the second inductance value L2, and the third inductance value L3 measured consecutively are small. A difference between the first inductance value L1 and the second inductance value L2, a difference between the second inductance value L2 and the third inductance value L3, and a difference between the first inductance value L1 and the third inductance value L3 are very small.

Accordingly, the controller may determine that the first inductance value L1 to the third inductance value L3 are within a predetermined range, and at this time, the controller may update the reference inductance value based on the first inductance value L1 to the third inductance value L3.

In contrast to this, in FIG. 8 (*b*), a characteristic value of a signal having the fourth inductance value L4 is consecutively measured at the fourth point in time t4 according to the period.

Since the fourth inductance value L4 is obtained, the controller may determine whether or not the second inductance value L2 to the fourth inductance value L4 are within a predetermined range, except the first inductance value L1.

The fourth inductance value L4 is rapidly decreased compared to the third inductance value L3. Here, the fourth inductance value L4 may be an inductance value that is instantaneously measured by an external stimulus.

The controller may determine that the second inductance value L2 to the fourth inductance value L4 are not within the predetermined range, and may maintain the preset reference inductance value without updating the reference inductance value.

Figure 9:
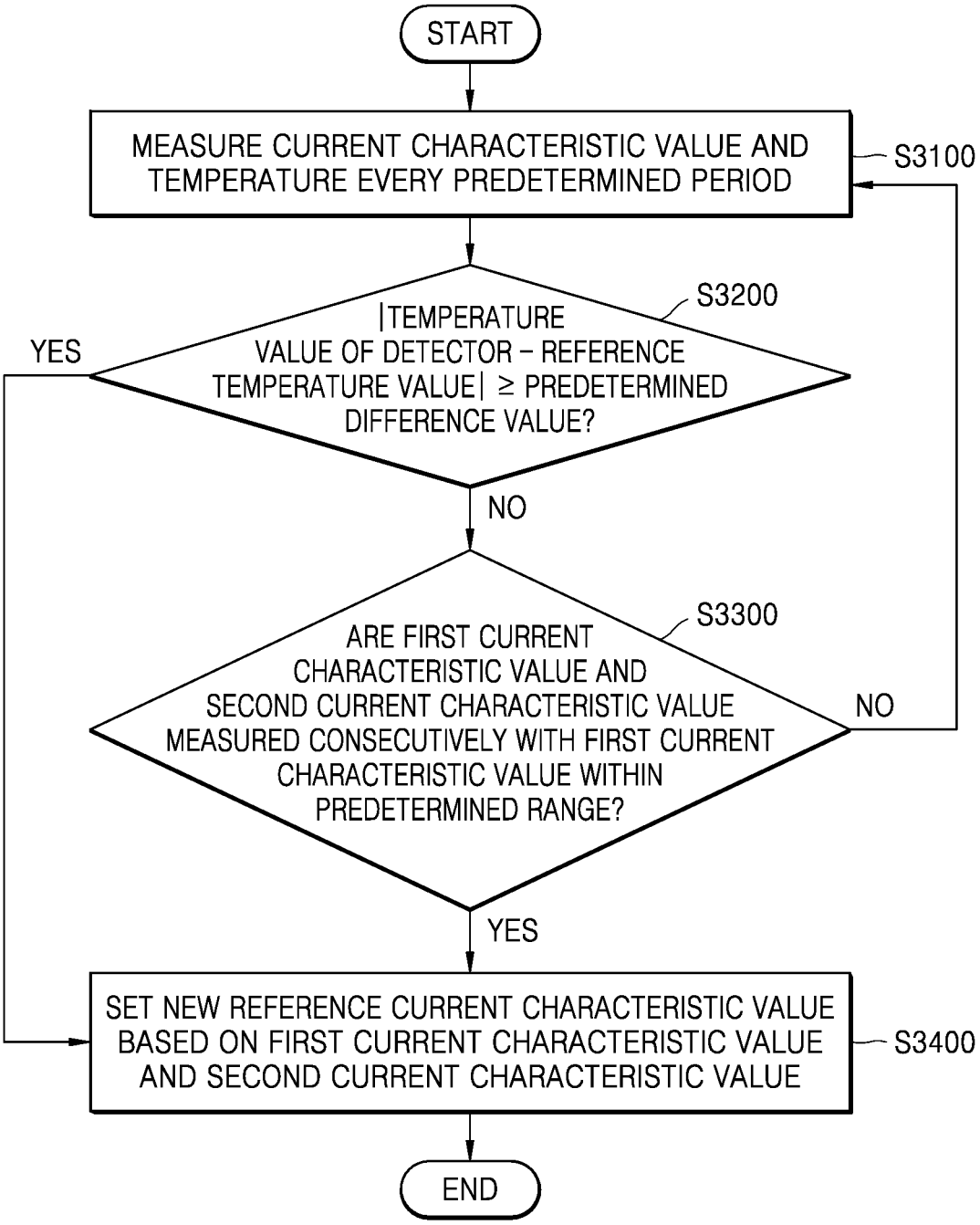
FIG. 9 is a flowchart of an operation method by which an aerosol generating apparatus sets a reference current characteristic value in consideration of temperature.

FIG. 9 is a flowchart of an operation method by which the aerosol generating apparatus sets a reference current characteristic value in consideration of the temperature.

Referring to FIG. 9, the aerosol generating apparatus 100 may measure the current characteristic value and the temperatures every predetermined period (S3100). In step S3100, the content described in step S2100 may be applied.

The aerosol generating apparatus 100 may compare a value of difference between a temperature value of the detector 160 and a reference temperature value to determine whether or not a difference between the temperature value of the detector 160 and the reference temperature value is greater than or equal to a predetermined difference value (S3200).

By comparing the temperature value of the detector 160 with the reference temperature value, the aerosol generating apparatus 100 may recognize a case where the temperature value of the detector 160 is too high or too low in order to remove influence of the temperature.

Here, the reference temperature value may be a preset fixed value, but according to one embodiment, the reference temperature value may be a value to be updated in real time by calculation of the controller. Specifically, the reference temperature value may be the temperature of the detector 160 at the time when the reference current characteristic value is set. In step S2300, when the measured current characteristic value is within a predetermined range, the reference current characteristic value is newly set, and at this point in time, the temperature of the detector 160 may be set as the reference temperature value.

When the difference between the temperature value of the detector 160 and the reference temperature value is less than a predetermined difference value, the aerosol generating apparatus 100 may determine whether or not the first current characteristic value and the second current characteristic value consecutively measured with the first current characteristic value is within a predetermined range (S3300).

When the difference between the temperature value of the detector 160 and the reference temperature value is less than the predetermined difference value, the aerosol generating apparatus 100 may determine that temperature correction is unnecessary. Accordingly, the aerosol generating apparatus 100 may be based on the first current characteristic value and the second current characteristic value consecutively measured with the first current characteristic value when setting the reference current characteristic value, as previously performed.

Step S3300 may include the content described in step S2200.

Moreover, when the difference between the temperature value of the detector 160 and the reference temperature value is greater than or equal to the predetermined difference value, the aerosol generating apparatus 100 may set a new reference current characteristic value based on the first current characteristic value and the second current characteristic value (S3400).

When the difference between the temperature value of the detector 160 and the reference temperature value is greater than or equal to the predetermined difference value, the aerosol generating apparatus 100 may determine that temperature correction is necessary. That is, the aerosol generating apparatus 100 compares a difference between the measured temperature value at the time when the reference current characteristic value is set and the current temperature value of the detector 160, and when there is a difference over a predetermined temperature value, it may be determined that there is a temperature error.

At this time, a current temperature of the current detector 160 is too high or too low compared to the temperature at the time when the preset reference temperature value is set, and thus, the aerosol generating apparatus 100 may reset the reference current characteristic value in consideration of this. The reference current characteristic value may be updated based on the first current characteristic value and the second current characteristic value as described in step S2300.

Accordingly, the controller may minimize influence of the temperature difference and determine an insertion state of the cigarette 500 based only on the current characteristic value changing according to approach of the electromagnetic inductor 580.

Figure 10:
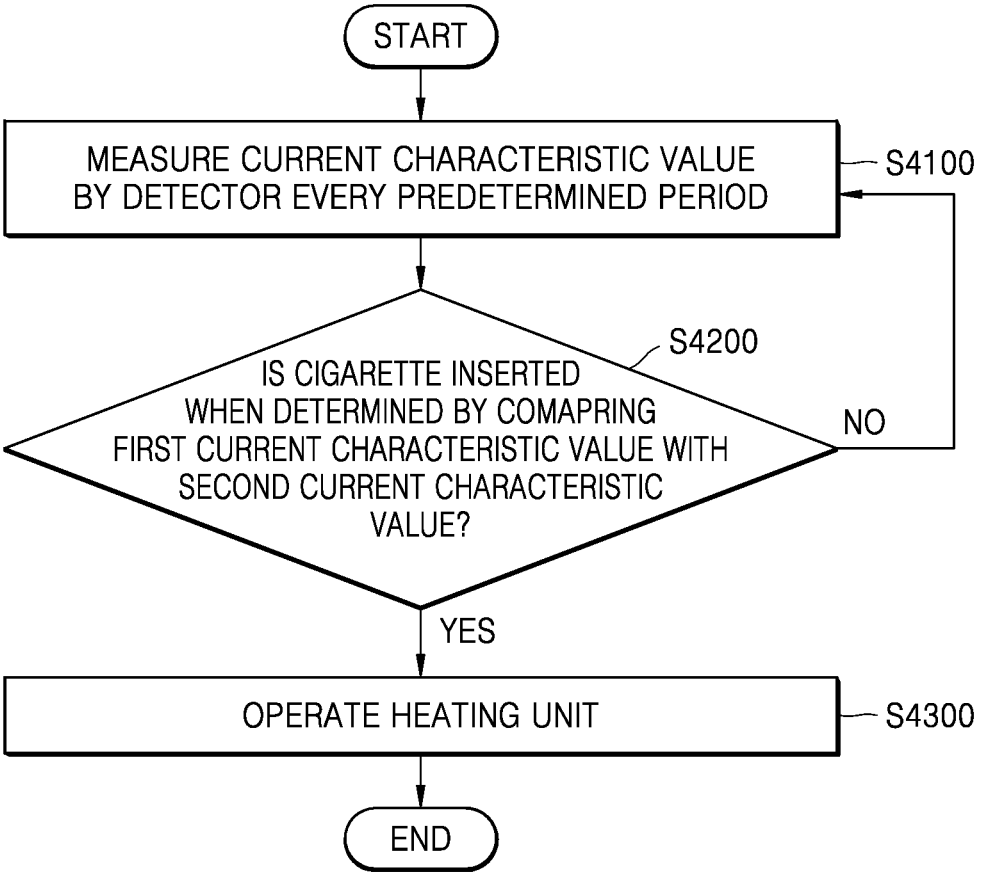
FIG. 10 is a flowchart illustrating another method by which an aerosol generating apparatus operates a heating unit according to an insertion state of a cigarette.

FIG. 10 is a flowchart illustrating another method by which the aerosol generating apparatus operates the heating unit according to the insertion state of the cigarette.

Referring to FIG. 10, the aerosol generating apparatus 100 may measure a current characteristic value every predetermined period by using the detector 160 (S4100). In step S4100, the contents described in step S1100 may be applied.

The aerosol generating apparatus 100 may compare the first current characteristic value with the second current characteristic value measured before the first current characteristic value to determine whether or not the cigarette 500 is inserted into the case 110 (S4200).

When a difference between the first current characteristic value and the second current characteristic value is great, the aerosol generating apparatus 100 may determine that a cigarette insertion state has changed between the points in times when the first current characteristic value and the second current characteristic value are respectively measured.

According to one embodiment, the first current characteristic value and the second current characteristic value may be consecutively measured. According to this, since a time interval between the first current characteristic value and the second current characteristic value is a short time corresponding to a period, it is possible to quickly and accurately detect a change in the insertion state of the cigarette occurring within the period.

According to S4200, the aerosol generating apparatus 100 may determine the insertion state of the cigarette 500 without using the reference value of the frequency or inductance described with reference to FIG. 6.

Further, according to S4200, influence of a property change of a coil due to an external factor such as an ambient temperature may be minimized. This is because the ambient temperature does not change so rapidly within a short time interval between measurement times of the first and second current characteristic values, and even if the temperature influences, the influence of the ambient temperature is canceled out in the process of obtaining a difference between the first and second current characteristic values. Accordingly, even if the current characteristic value changes according to an external factor such as ambient temperature, the difference between the first current characteristic value and the second current characteristic value is hardly influenced by a change of the external factor such as an ambient temperature.

For the sake of convenience, the first current characteristic value and the second current characteristic value are described, but content relating thereto may also be applied to a third current characteristic value measured consecutively with the second current characteristic value and subsequent current characteristic values measured consecutively.

The aerosol generating apparatus 100 may control the heating unit 130 to operate (S4300). The aerosol generating apparatus 100 may operate the heating unit 130 when it is determined that the cigarette 500 of a predetermined type is inserted.

Figure 11:
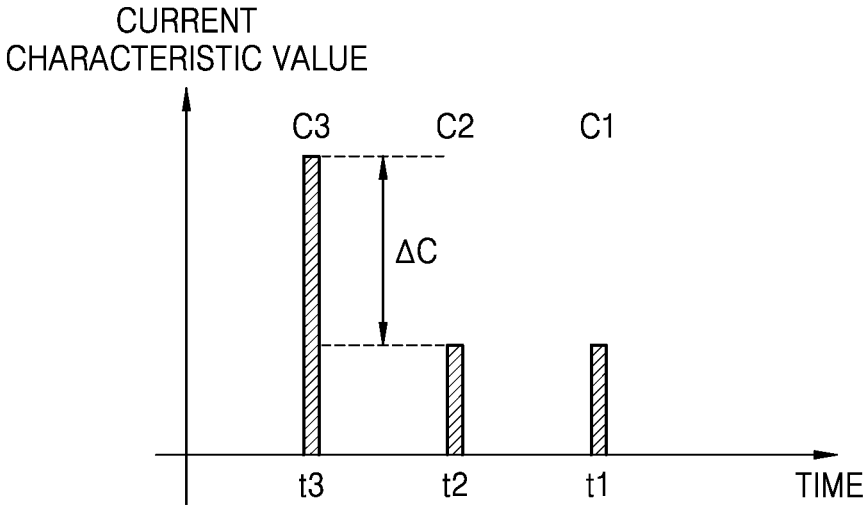
FIG. 11 is a graph of current characteristic values detected by an aerosol generating apparatus.

FIG. 11 is a graph of the current characteristic values detected by the aerosol generating apparatus.

Referring to FIG. 11, the aerosol generating apparatus 100 measures a first current characteristic value C1 at the first point in time t1, a second current characteristic value C2 at the second point in time t2, and a third current characteristic value C3 at the third point in time t3 by using the detector 160, according to periods.

A value of difference between the first current characteristic value C1 and the second current characteristic value C2 is very small.

However, the third current characteristic value C3 increases rapidly, and thus, a difference ΔC between the third current characteristic value C3 and the second current characteristic value C2 is greater than a reference difference value. At this time, the aerosol generating apparatus 100 may determine that insertion or separation the cigarette 500 has occurred.

For the sake of convenience, the current characteristic value increases as the cigarette 500 is inserted or separated, but the content of FIG. 11 is not limited thereto. That is, even in a case where the current characteristic value decreases when the cigarette 500 is inserted or separated, the content of FIG. 11 may be applied, and the content of FIG. 11 may be understood as indicating that the amount of change in the current characteristic value is greater than the reference difference value.

In addition, increase/decrease of the current characteristic value when the cigarette 500 is inserted may be opposite to increase/decrease sign of the current characteristic value when the cigarette 500 is separated.

Figure 12:
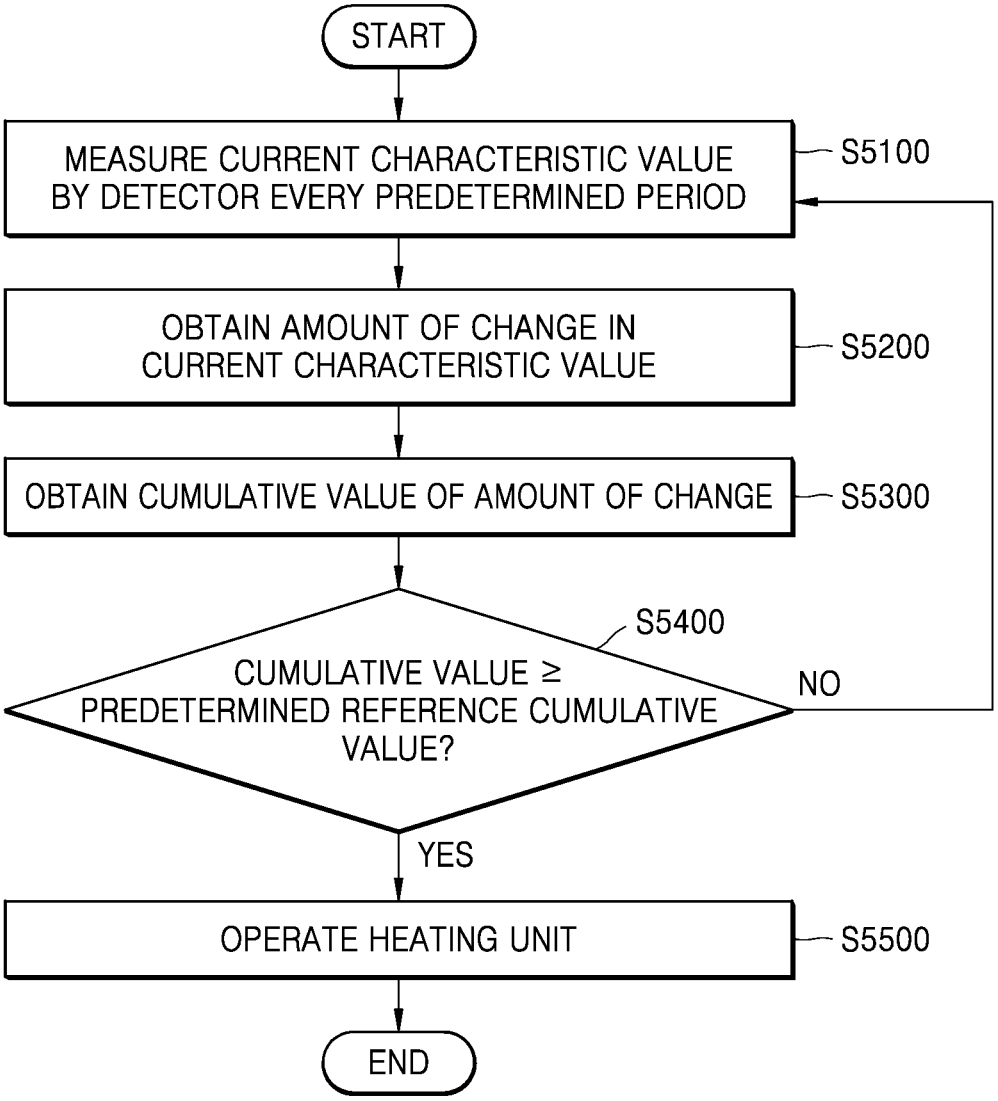
FIG. 12 is a flowchart illustrating another method by which an aerosol generating apparatus operates a heating unit according to an insertion state of a cigarette.
Figure 14:
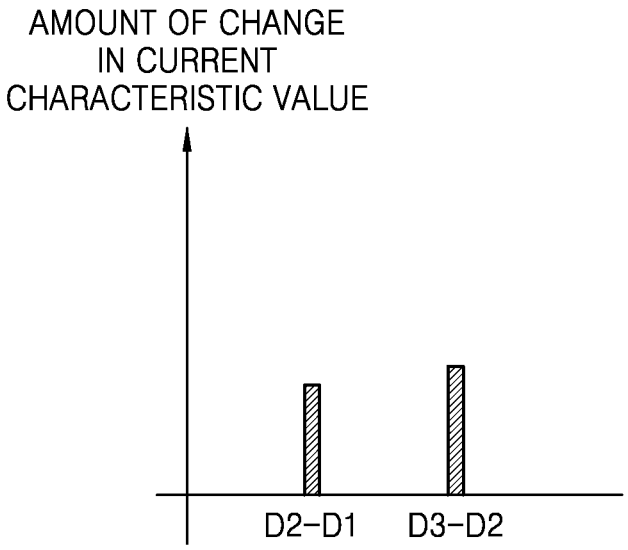
FIG. 14 is a graph of the amount of change in current characteristic values of FIG. 13.
Figure 15:
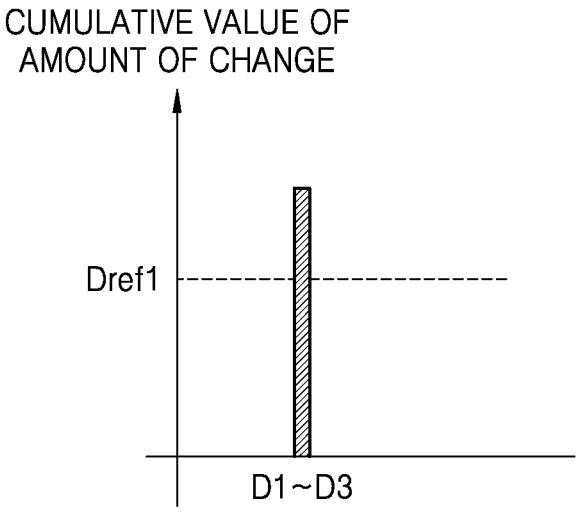
FIG. 15 is a graph of cumulative values of the amount of change in current characteristic values of FIG. 14.

FIG. 12 is a flowchart illustrating another method by which the aerosol generating apparatus operates the heating unit according to the insertion state of the cigarette. As described in the respective steps of FIG. 12, FIG. 13 is a graph of an example of current characteristic values detected by an aerosol generating apparatus, FIG. 14 is a graph of the amount of change in the current characteristic values of FIG. 13, and FIG. 15 is a graph of cumulative values of the amount of change in the current characteristic values.

Referring to FIG. 12, the aerosol generating apparatus may measure the current characteristic values by using the detector 160 every predetermined period (S5100).

The contents described in step S1100 may be applied to step S5100.

Figure 13:
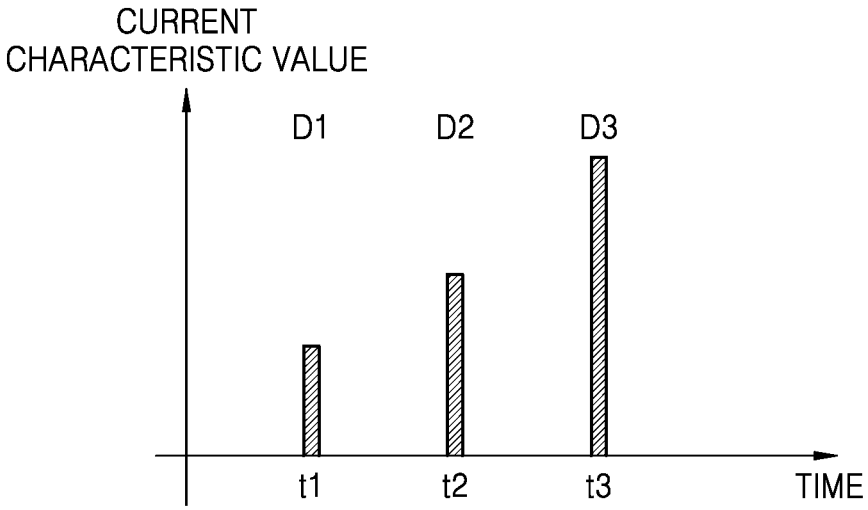
FIG. 13 is a graph of current characteristic values detected by an aerosol generating apparatus.

Referring to FIG. 13, as an example, the aerosol generating apparatus 100 may measure a first current characteristic value D1 at the first point in time t1, a second current characteristic value D2 at the second point in time t2, and a third current characteristic value D3 at the third point in time t3 by using the detector 160, according to periods.

According to FIG. 13, the third current characteristic value D3 is greater than the second current characteristic value D2, and the second current characteristic value D2 is greater than the first current characteristic value D1.

For the sake of convenience, it is assumed that the aerosol generating apparatus 100 described with reference to FIG. 13 is designed to increase the current characteristic value as the cigarette 500 is inserted and to decrease the current characteristic value as the cigarette 500 is separated. However, the operation of the aerosol generating apparatus 100 is not limited to this, and the current characteristic value may decrease when the cigarette 500 is inserted and the current characteristic value may increase when the cigarette 500 is separated, according to the type of the current characteristic value, an operation algorithm, and so on.

The aerosol generating apparatus 100 may obtain the amount of change in the current characteristic value (S5200).

The aerosol generating apparatus 100 may obtain the amount of change in the current characteristic value by obtaining a value of difference between the respective current characteristic values measured consecutively.

As the cigarette 500 approaches or moves away from the detector 160, the amount of change in the current characteristic value may change to a positive or negative value, and if the cigarette 500 does not move, the amount of change in the current characteristic value may be zero. Alternatively, the current characteristic value may temporarily change as a metal body or the like in addition to the cigarette 500 influences the detector 160.

Referring to FIG. 14, since the third current characteristic value D3 is greater than the second current characteristic value D2, a value obtained by subtracting the second current characteristic value D2 from the third current characteristic value D3 is a positive number. Further, since the second current characteristic value D2 is larger than the first current characteristic value D1, a value obtained by subtracting the first current characteristic value D1 from the second current characteristic value D2 is a positive number.

The aerosol generating apparatus 100 may obtain a cumulative value of the amount of change (S5300).

The aerosol generating apparatus 100 may obtain the cumulative value of the amount of change in the current characteristic values measured consecutively.

The amount of change in the plurality of current characteristic values may include information on how the current characteristic values change while the respective current characteristic values are detected.

Accordingly, it is more effective to determine whether or not the cigarette 500 is inserted based on the cumulative value of the amount of change in the current characteristic value rather than to determine whether or not the cigarette 500 is inserted based on the amount of change in two current characteristic values.

Referring to FIG. 15, the aerosol generating apparatus 100 may obtain, by calculation, a cumulative value of the amount of change in the respective current characteristic values from the first current characteristic value D1 to the third current characteristic value D3.

The aerosol generating apparatus 100 may determine whether or not the obtained cumulative value is greater than or equal to a predetermined cumulative value (S5400).

For example, when insertion or separation of the cigarette 500 occurs, the current characteristic value may be sequentially changed multiple times, and the amount of change may have the same sign.

Moreover, when an external factor such as approach of a metal body momentarily influences, a change in the current characteristic value may occur temporarily, and the amount of change in the current characteristic value may occur in an opposite direction as the external factor disappears.

Accordingly, when determining based on the cumulative value, the aerosol generating apparatus 100 may detect the amount of change in the current characteristic value occurring sequentially in the same direction, and may not react to the amount of change in the current characteristic value occurring due to an external factor appearing temporarily.

Referring to FIG. 15, the aerosol generating apparatus 100 may recognize that insertion of the cigarette 500 has occurred because the cumulative value of the amount of change in the current characteristic values D1 to D3 is greater than or equal to a predetermined cumulative value Dref.

The aerosol generating apparatus 100 may operate the heating unit 130 (S5500). The aerosol generating apparatus 100 may operate the heating unit 130 when the cigarette 500 is inserted and may not operate the heating unit 130 when the cigarette 500 is separated.

Moreover, the aerosol generating apparatus 100 may measure a current characteristic value at regular intervals according to periods, store the measured current characteristic values in a memory, and determine the insertion state of the cigarette 500 based thereon. Thereby, even if a user input is not received, when the cigarette 500 is inserted, the aerosol generating apparatus 100 may automatically heat the cigarette 500, and thus, convenience is increased.

Alternatively, when receiving an input for a button for operating the heating unit 130 from a user, the aerosol generating apparatus 100 may start to measure the current characteristic value according to periods. The aerosol generating apparatus 100 may operate the heating unit 130 only when two conditions of reception of a user input and insertion of the cigarette 500 are satisfied, and thus, safety is increased.

Alternatively, the aerosol generating apparatus 100 may not measure the current characteristic value in a low-power standby mode and measure the current characteristic value while waking up according to a specific period.

Figure 16:
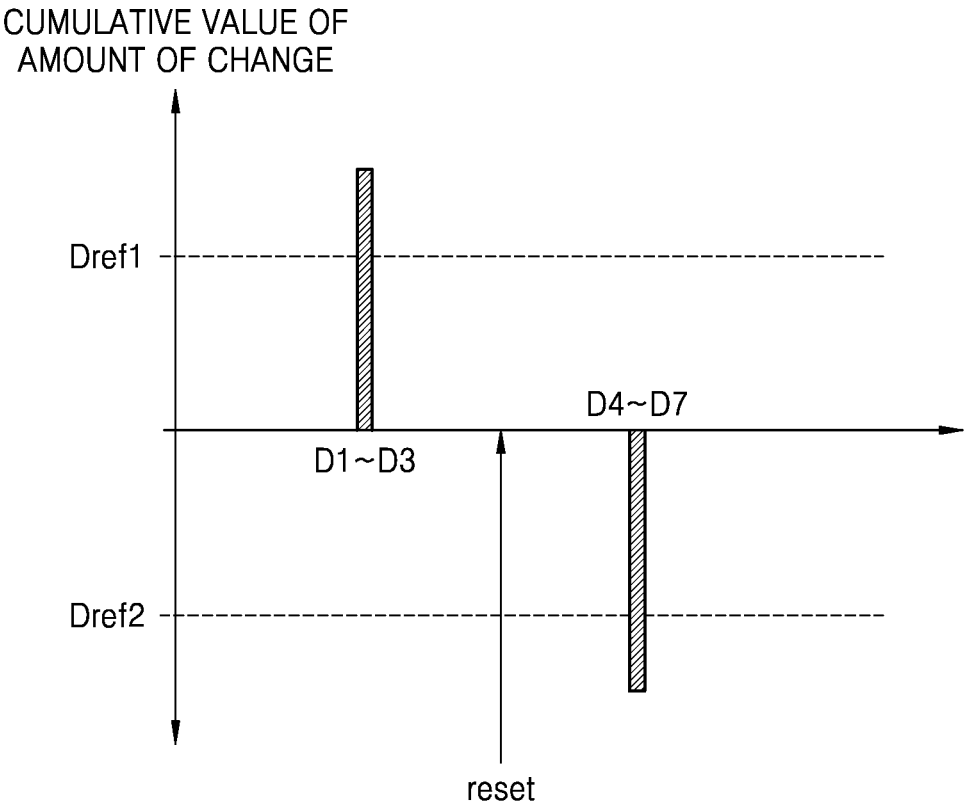
FIG. 16 is a diagram of an aerosol generating apparatus that initializes a cumulative value.

FIG. 16 is a diagram illustrating that an aerosol generating apparatus initializes a cumulative value.

The aerosol generating apparatus 100 may initialize a cumulative value when a predetermined condition is satisfied.

The condition for initializing the cumulative value includes, for example, a case where the cumulative value is greater than or equal to a predetermined reference cumulative value as the insertion state of the cigarette 500 changes, a case where a cover coupling state changes, or a case where a predetermined time elapses, etc.

The aerosol generating apparatus 100 may initialize the cumulative value when the insertion state of the cigarette 500 changes. The amount of change in the current characteristic value generated when the cigarette 500 is inserted may have a sign opposite to the amount of change in the current characteristic value generated when the cigarette 500 is separated. Accordingly, if the cumulative value is not initialized when insertion or separation of the cigarette 500 occurs, the cumulative value changes according to the insertion and separation of the cigarette 500, and thus, it is difficult to determine the insertion state of the cigarette 500 based on the cumulative value.

Referring to FIG. 16, if the cumulative value of the amount of change in the current characteristic values D1 to D3 becomes greater than or equal to a reference cumulative value Dref1 when the cigarette 500 is inserted, the aerosol generating apparatus 100 may initialize the cumulative value.

As the cumulative value is initialized and the cigarette 500 is separated subsequently, and the cumulative value of the amount of change in the current characteristic values D4 to D6 may be accumulated to have signs opposite to the signs of the cumulative value of the amount of change in the current characteristic values D1 to D3 when the cigarette 500 is inserted.

Thereafter, the aerosol generating apparatus 100 may recognize that the cigarette 500 is separated when the cumulative value of the amount of change in the current characteristic values D4 to D6 reaches a reference cumulative value Dref2.

In addition, the aerosol generating apparatus 100 may initialize the cumulative value when the cover coupling state changes. When the cover including the electromagnetic inductor 580, which will be described below with reference to FIGS. 23 to 29, is coupled to and separated from the case 110, the amount of change occurring in the current characteristic value may also have signs opposite to each other. Accordingly, the aerosol generating apparatus 100 may initialize the cumulative value when an event in which the cover is coupled or separated occurs.

Alternatively, the aerosol generating apparatus 100 may initialize the cumulative value when a predetermined time elapses. Even if the cigarette is not inserted or not separated for a predetermined period, a slight change in the current characteristic value may occur from time to time due to a surrounding environment, and if the amount of change continues to accumulate, the cumulative value may become close to the reference cumulative value. Accordingly, when a predetermined time elapses, the cumulative value may be initialized to effectively detect a cigarette insertion state.

In addition, by initializing the cumulative value periodically, the aerosol generating apparatus 100 may reduce the amount of computation.

Figure 17:
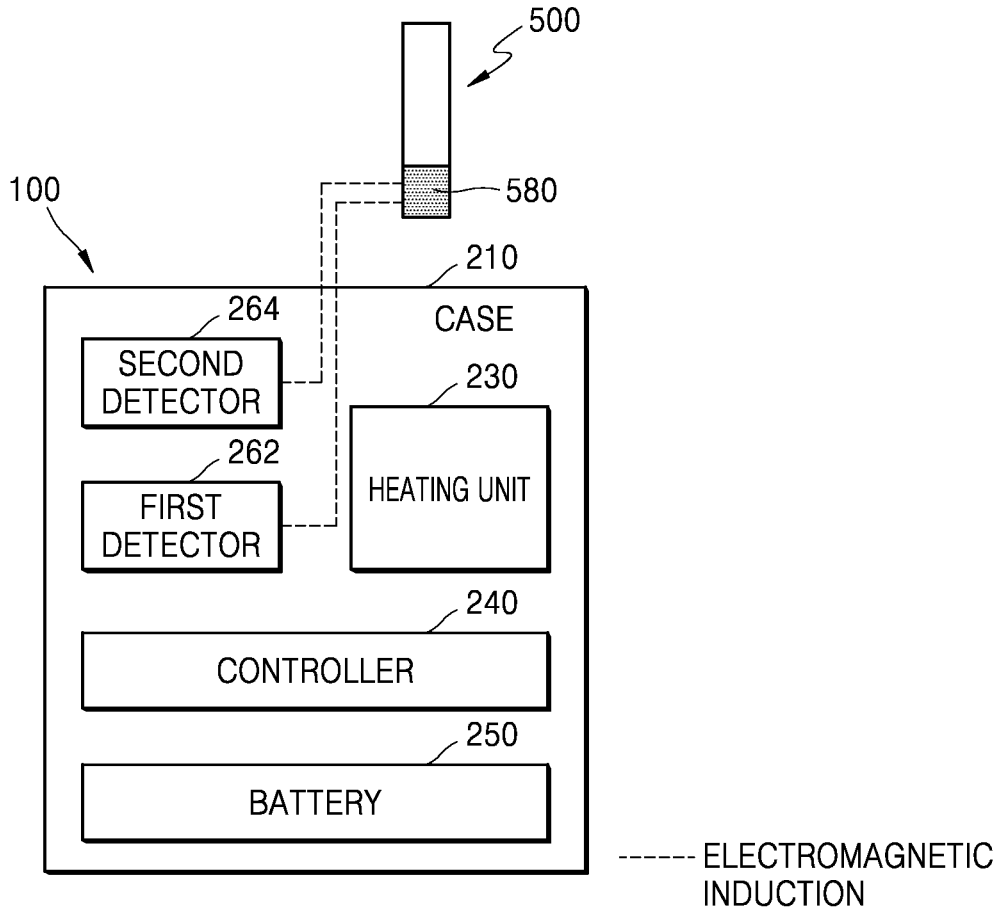
FIG. 17 is a block configuration diagram illustrating another embodiment of the aerosol generating apparatus.

FIG. 17 is a block configuration diagram illustrating another embodiment of the aerosol generating apparatus.

The contents described above on the detector 160, the heating unit 130, the controller 140, the battery 150, and so on may be applied to detectors 262 and 264, a heating unit 230, a controller 240, and a battery 250 of the aerosol generating apparatus 200 according to another embodiment which will be described below.

Figure 18:
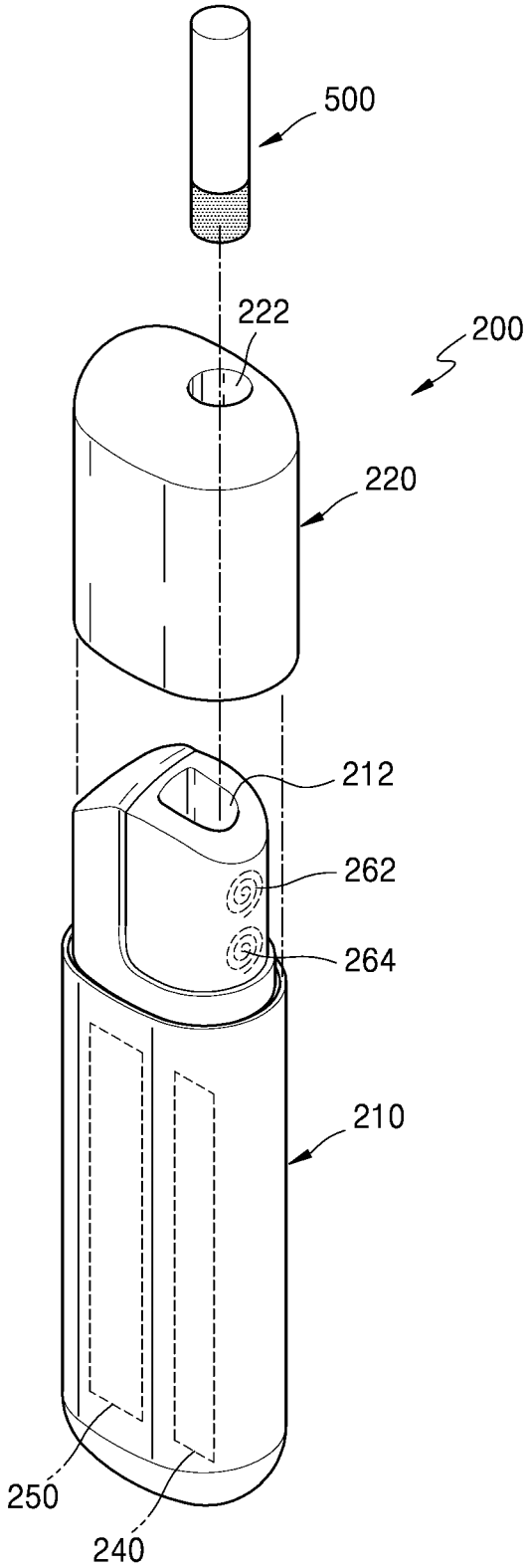
FIG. 18 is a perspective view of the aerosol generating apparatus according to FIG. 17.

FIG. 18 is a perspective view of the aerosol generating apparatus according to FIG. 17.

Referring to FIG. 18, the aerosol generating apparatus 200 may further include a cover 220 coupled to the case 210. The cover 220 forms an exterior of the aerosol generating apparatus 200 together with the case 210. The cover 220 may be coupled to the case 210 to protect inner configuration elements of the aerosol generating apparatus 200.

FIG. 18 illustrates that the cover 220 and the case 210 are separated from each other. In a state in which the cover 220 and the case 210 are separated from each other, an inner space and the heating unit 230 of the aerosol generating apparatus 200 may be exposed to the outside. Thus, after a user who finishes use of the cigarette 500 separates the cigarette 500 from the aerosol generating apparatus 200, a cleaning operation of removing a tobacco material that may remain inside the aerosol generating apparatus 200 may be performed.

When the cover 220 is coupled, an outer hole 222 of the cover 220 and an insertion hole 212 of the case 210 may be aligned. The cigarette 500 may be inserted into the insertion hole 212 through the outer hole 222. Thereby, an aerosol generating material is fixed, and thus, it is possible to prevent the aerosol generating material from being separated from the case 210 to fall out.

The first detector 262 and the second detector 264 may be provided in the case 210. For example, the first detector 262 and the second detector 264 may be disposed on the top of the case 210 to which the cover 220 is coupled. As another example, the first detector 262 and the second detector 264 may be disposed in a cigarette accommodation portion in which the cigarette 500 is inserted and accommodated. At this time, the cigarette accommodation portion may have a cylindrical shape including an inner surface and an outer surface, the first detector 262 and the second detector 264 may be disposed between an inner surface and an outer surface of the cigarette accommodation portion.

As the cigarette 500 is inserted into the case 210, a separation distance between the electromagnetic inductor 580 and the detectors 262 and 264 may be reduced. The detectors 262 and 264 may detect a change in characteristics of a current flowing through a coil as the electromagnetic inductor 580 approaches. The controller 240 may determine that the cigarette 500 is inserted into the case 210 based on the detected change in characteristic of the current. In contrast to this, when the cigarette 500 is separated from the case 210, the separation distance between the electromagnetic inductor 580 and the detectors 262 and 264 may increase, and thus, the detectors 262 and 264 may detect a change in characteristics of a current flowing through the coil generated according to this. The controller 240 may determine that the cigarette 500 is separated from the case 210 based on the detected change in characteristics of the current.

According to one embodiment illustrated in FIG. 18, the controller 240 and the battery 250 may be disposed in the lower portion of the case 210. The controller 240 and the battery 250 may have shapes extending in one direction and may be disposed to extend in an extending direction of the case 210.

The battery 250 may be charged by receiving power from the outside through a terminal formed at the bottom of the case 210. The aerosol generating apparatus 200 may configure a system together with a separate cradle (not illustrated). For example, the cradle may be used to charge the battery 250 of the aerosol generating apparatus 200. Alternatively, the heating unit 230 may be heated while the cradle and the aerosol generating apparatus 200 are coupled to each other.

An input unit (not illustrated) may be disposed on an outer surface of the case 210. The input unit may be, for example, a button, a switch, or a touch screen.

Figure 19:
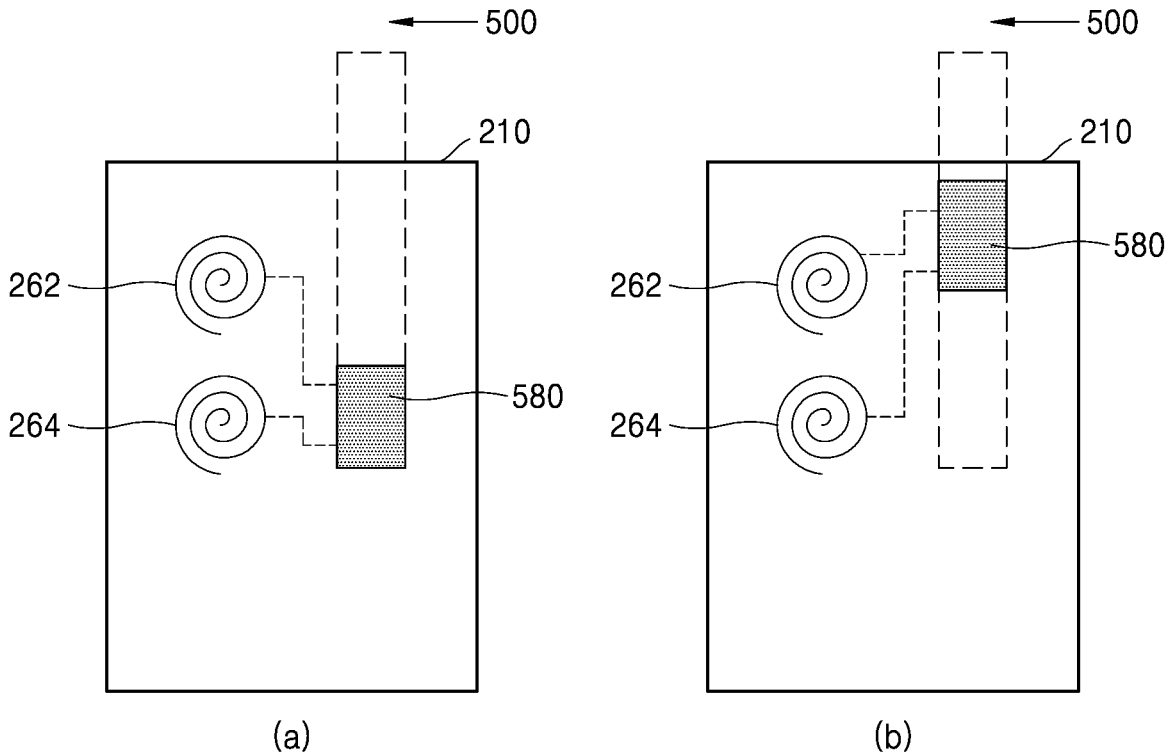
FIG. 19 is a view of an aerosol generating apparatus detecting an insertion state of a cigarette.
Figure 20:
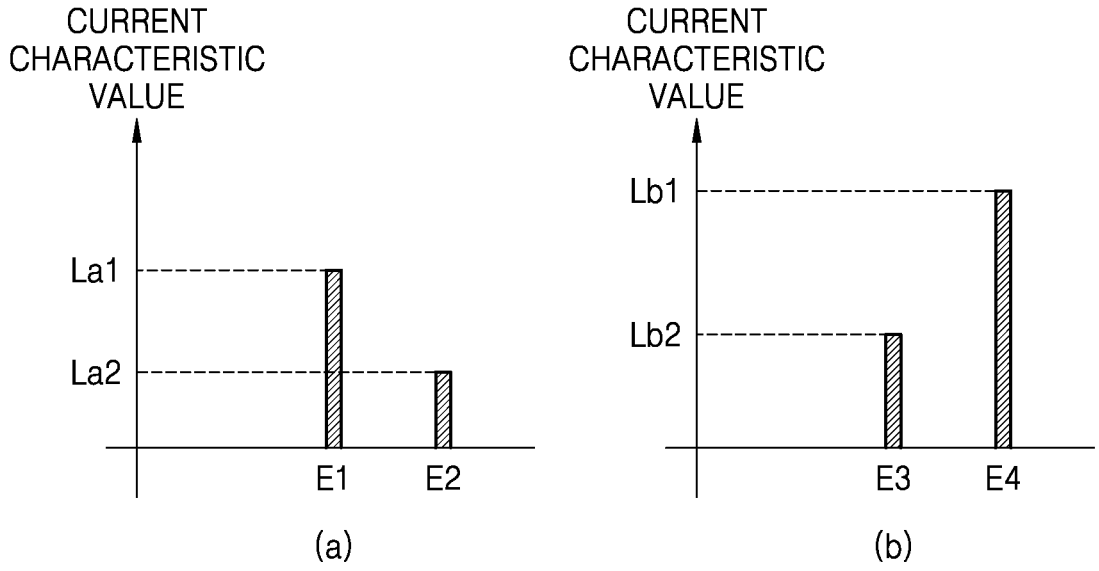
FIG. 20 is a graph of current characteristic values detected by an aerosol generating apparatus.

FIG. 19 is a diagram illustrating that an aerosol generating apparatus detects a cigarette insertion state, and FIG. 20 is a graph of current characteristics detected by the first detector 262 and the second detector 264 in the case of FIG. 19.

Referring to FIG. 19, the first detector 262 and the second detector 264 may be disposed to be spaced apart in a first direction. The first detector 262 may be disposed on a lower side, and the second detector 264 may be disposed on an upper side.

Here, the first direction coincides with a direction in which the cigarette 500 extends. In addition, the first direction coincides with a direction in which the cigarette 500 is inserted into the aerosol generating apparatus 200. In addition, the first direction coincides with a direction in which the electromagnetic inductor 580 surrounding the cigarette 500 extends. For the sake of convenience, the first direction is interchangeably used with the vertical direction in this specification.

Since the first detector 262 and the second detector 264 are disposed to be spaced apart in the vertical direction, it is possible to sequentially detect that the cigarettes 500 are inserted. In addition, the first detector 262 and the second detector 264 may detect a location of the cigarette 500 in the vertical direction, a length of the cigarette 500 extending in the vertical direction, and so on.

The first detector 262 and the second detector 264 may detect the electromagnetic inductor 580 by detecting a change in characteristics of a current flowing through a coil as the cigarette 500 is inserted. Here, current characteristic values that the first detector 262 and the second detector 264 detect by the electromagnetic inductor 580 may be different from each other, according to a length, a location, a shape, and so on of the electromagnetic inductor 580.

The controller 240 may identify the length, the location, the shape, and so on of the electromagnetic inductor 580 based on the current characteristic values respectively received from the first detector 262 and the second detector 264, thereby identifying a type of the cigarette 500 including the electromagnetic inductor 580.

Referring to FIG. 20, the amount of change in the current characteristic value detected by the first detector 262 and a second detector 264 may be, for example, the amount of change in a frequency value or the amount of change in an inductance value. The closer the electromagnetic inductor 580 is to the first detector 262 or the second detector 262, the greater the amount of change in the current characteristic value detected by each detector.

As illustrated in of 19 (*a*), when the electromagnetic inductor 580 is located at a lower end of the cigarette 500, a distance between the first detector 262 and the electromagnetic inductor 580 is closer than a distance between the second detector 264 and the electromagnetic inductor 580.

FIG. 20 (*a*) illustrates the amount of change in the current characteristic values detected by the first detector 262 and the second detector 264 in a case illustrated in FIG. 19 (*a*).

A current characteristic value La1 detected by the first detector 262 may indicate a greater change in the current characteristic value than a current characteristic value La2 detected by the second detector 264. At this time, the controller 240 may determine that the electromagnetic inductor 580 is located at the lower end of the cigarette 500.

As illustrated in FIG. 19 (*b*), when the electromagnetic inductor 580 is located at an upper end of the cigarette 500, a distance between the second detector 264 and the electromagnetic inductor 580 may be closer than a distance between the first detector 262 and the electromagnetic inductor 580.

FIG. 20 (*b*) illustrates the amount of change in the current characteristic value detected by the first detector 262 and the second detector 264 in a case illustrated in FIG. 19 (*b*).

A current characteristic value Lb1 detected by the first detector 262 may indicate a smaller change in the current characteristic value than a current characteristic value Lb2 detected by the second detector 264. At this time, the controller 240 may determine that the electromagnetic inductor 580 is located at the upper end of the cigarette 500.

Although not illustrated, when the electromagnetic inductor 580 is located in the middle of the cigarette 500, the changes in the current characteristic value measured by the first detector 262 and the second detector 264 may be similar. At this time, the controller 240 may determine that the electromagnetic inductor 580 is located in the middle of the cigarette 500.

Figure 21:
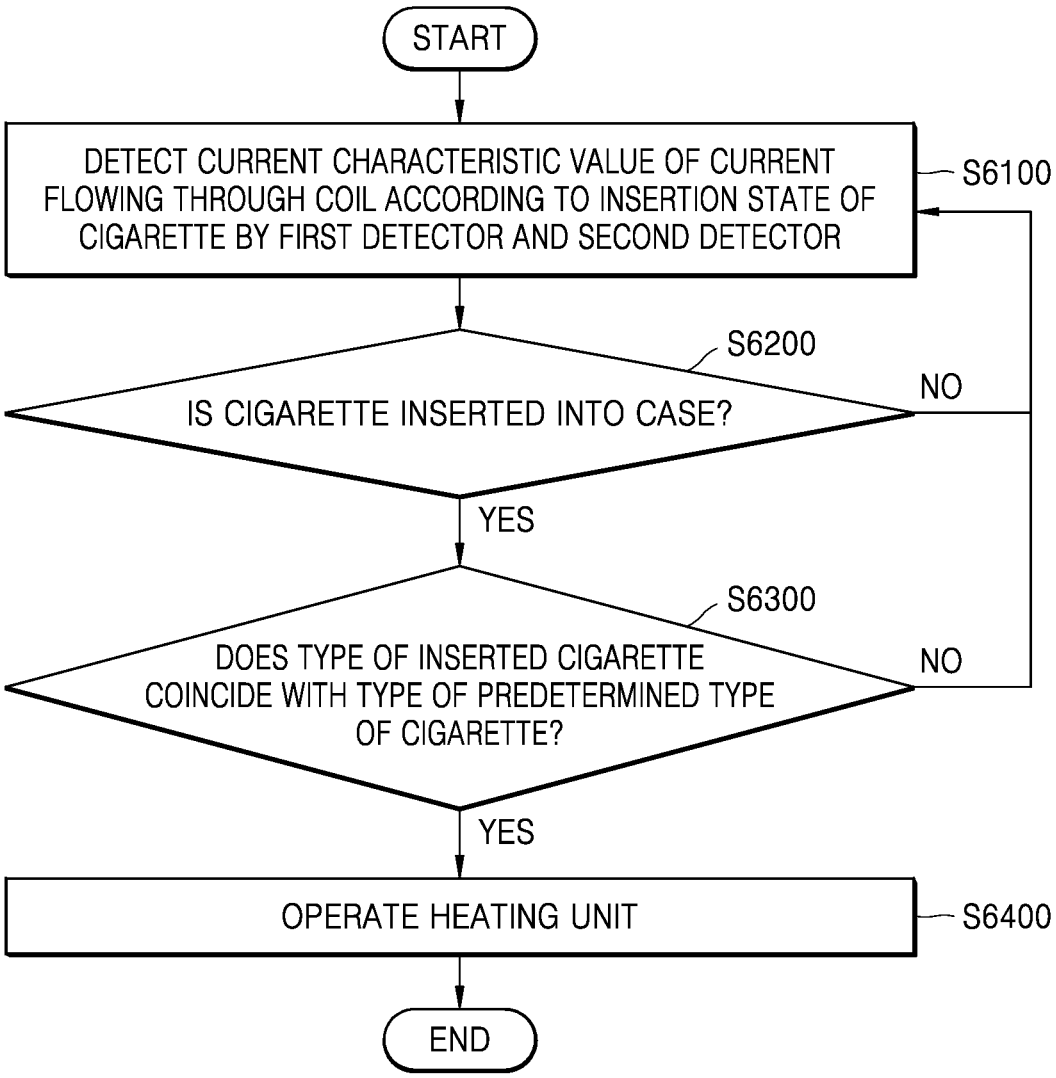
FIG. 21 is a flowchart of a method by which an aerosol generating apparatus controls a heating unit according to an insertion state of a cigarette.

FIG. 21 is a flowchart of a method by which an aerosol generating apparatus controls a heating unit according to a cigarette insertion state.

Referring to FIG. 21, the aerosol generating apparatus 200 may detect a current characteristic value of a current flowing through a coil according to the insertion state of the cigarette 500 by using the first detector 262 and the second detector 264. (S6100).

The detector may detect that a characteristic value of the current flowing through the coil changes as the electromagnetic inductor 580 in the cigarette 500 approaches according to the method described with reference to FIGS. 17 to 20.

The aerosol generating apparatus 200 may determine an insertion state of the cigarette 500 (S6200).

The controller 240 may determine the insertion state of the cigarette 500 based on the current characteristic values detected by the first detector 262 and the second detector 264. According to another embodiment, the controller 240 may determine the insertion state of the cigarette 500 by comparing and analyzing the current characteristic values detected by the first detector 262 and the second detector 264. According to another embodiment, the controller 240 may determine the insertion state of the cigarette 500 based only on a current characteristic value detected by either the first detector 262 or the second detector 264.

The controller 240 may determine the insertion state of the cigarette 500 based on the current characteristic values measured by using the first detector 262 and the second detector 264 according to the method described above with reference to FIGS. 17 to 20.

As another example, the controller 240 may obtain at least one of a quality factor, an effective resistance, and an impedance value of the coil by calculation based on the detected current. The controller 240 may determine the insertion state of the cigarette 500 based on the obtained coil quality factor, effective resistance, impedance value, and so on of the coil.

The aerosol generating apparatus 200 may determine whether or not a type of the inserted cigarette 500 coincides with a predetermined type of the cigarette 500 (S6300).

The controller 240 may identify the type of the inserted cigarette 500 based on the current characteristic values detected by the first detector 262 and the second detector 264. According to one embodiment, the controller 240 may identify the type of the cigarette 500 by comparing and analyzing the current characteristic values detected by the first detector 262 and the second detector 264, or according to another embodiment, the controller 240 may identify the type of the cigarette 500 based only on a current characteristic value detected by either the first detector 262 or the second detector 264.

The current characteristic values that the first detector 262 and the second detector 264 detect by using by the electromagnetic inductor 580 may be different from each other, according to a length, a location, a shape, and so on of the electromagnetic inductor 580. The controller 240 may identify the type of the cigarette 500 by identifying the length, the location, and the shape of the electromagnetic inductor 580 based on the current characteristic values respectively received from the first detector 262 and the second detector 264 according to the method described above with reference to FIGS. 17 to 20.

Step S6300 may be simultaneously performed with step S6200 or may be performed after step S6200.

The aerosol generating apparatus 200 may control the heating unit 230 to operate (S6400). The controller 240 may operate the heating unit 230 when the cigarette 500 is inserted into the aerosol generating apparatus 200 and the type of the inserted cigarette 500 coincides with the type of the predetermined cigarette 500.

Here, the meaning of operating the heating unit 230 may include not only immediately heating the heating unit 230, but also allowing the heating unit 230 to operate.

The type of the cigarette 500 may be various types in terms of content of a tobacco material, presence and performance of a cooling filter, presence of the front end plug 53, etc.

The aerosol generating apparatus 200 may store, in a memory, control scenario of a heating unit 230, which may include identifiable types of the cigarette 500, and a heating time, a heating intensity, a heating period, and so on which are optimal for each type of the cigarette 500. The aerosol generating apparatus 200 may control the heating unit 230 differently with reference to the heating unit 230 control scenario stored in the memory according to the type of the inserted cigarette 500.

For example, when receiving a user input for smoking in a state in which the cigarette 500 corresponding to a predetermined type of the cigarette 500 is inserted into the aerosol generating apparatus 200, the aerosol generating apparatus 200 may start a heating operation. Thereby, the heating operation is performed only when the cigarette 500 is inserted, and thus, safety may increase.

Moreover, when the cigarette 500 is not inserted into the aerosol generating apparatus 200 or the type of the inserted cigarette 500 is inconsistent with a predetermined type of the cigarette 500, the aerosol generating apparatus 200 may not operation the heating unit 230. For example, the aerosol generating apparatus 200 may stop operation of the heating unit 230 when the cigarette 500 is separated from the aerosol generating apparatus 200 during the operation of the heating unit 230.

Figure 22:
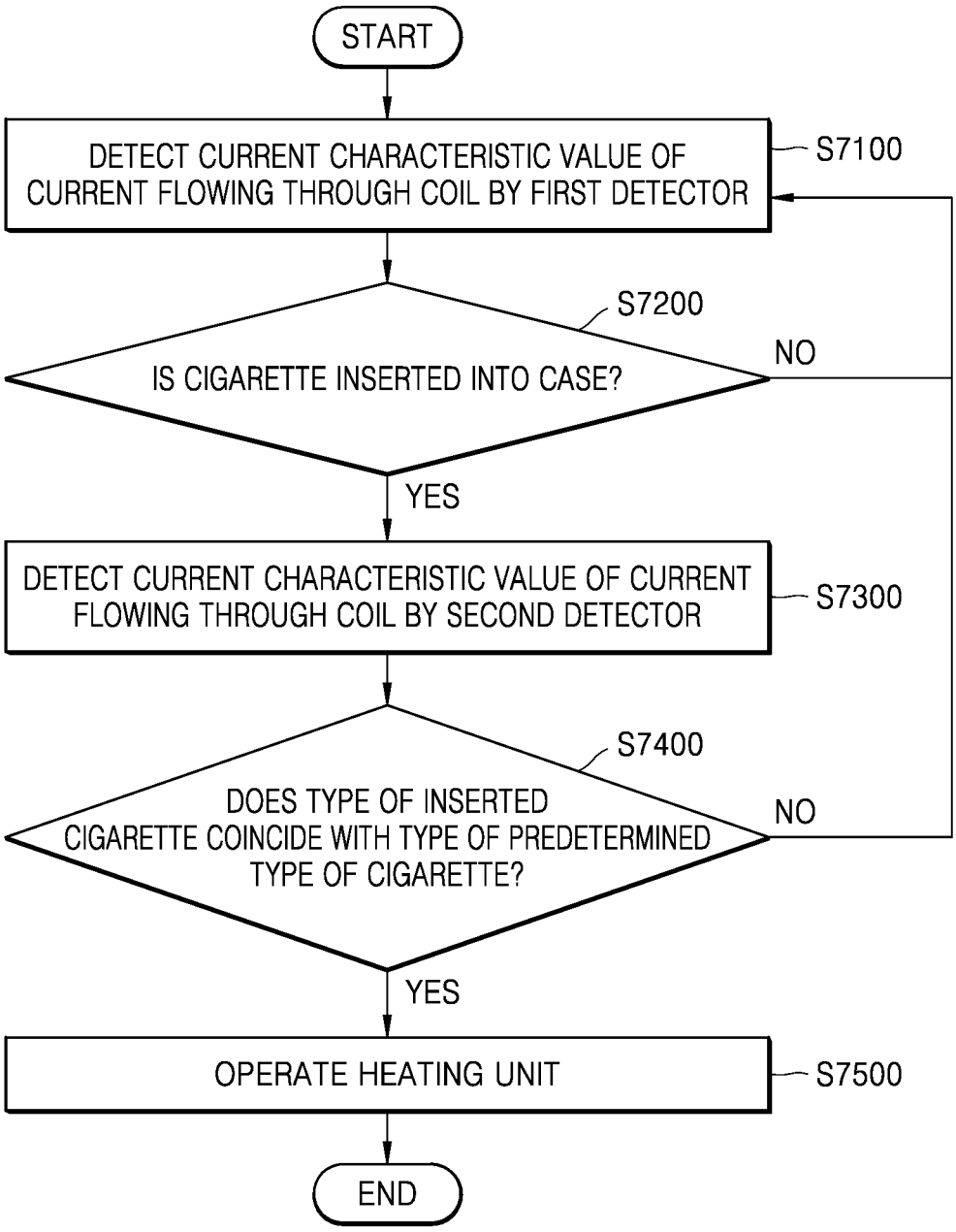
FIG. 22 is a flow chart of another method by which the aerosol generating controls a heating unit according to an insertion state of a cigarette.

FIG. 22 is a flowchart of another method by which an aerosol generating apparatus controls a heating unit according to a cigarette insertion state.

Referring to FIG. 22, the aerosol generating apparatus 200 may detect a current characteristic value of a current flowing through a coil by using the first detector 262 (S7100) and may determine an insertion state of the cigarette 500 based on the current characteristic value detected by using the first detector 262 (S7200).

The aerosol generating apparatus 200 may detect a change in the current characteristic value by using either the first detector 262 or the second detector 264 according to various characteristics such as a shape, a location, a type, and so on of the electromagnetic inductor 580 when the cigarette 500 is inserted. For example, when the electromagnetic inductor 580 is located at a lower end of the cigarette 500, the first detector 262 located below the second detector may be more effective in detecting insertion of the cigarette 500 than the second detector. Accordingly, the controller 240 may determine an insertion state of the cigarette 500 based on the current characteristic value detected by the first detector 262.

The aerosol generating apparatus 200 may detect a characteristic value of a current flowing through a coil by using the second detector (S7300), and may determine whether or not the type of the inserted cigarette 500 coincides with a predetermined type of the cigarette 500 based on the current characteristic value detected by using the second detector (S7400).

The second detector may identify the type of the inserted cigarette 500 based on various characteristics such as the shape, the location, and the type of the electromagnetic inductor 580.

For example, a length of the electromagnetic inductor 580 extending upward from a lower end of the cigarette 500 may be different for each cigarette 500. Since the second detector is located on an upper side of the cigarette 500, it may effectively measure the length of the electromagnetic inductor 580.

Specifically, if the electromagnetic inductor 580 extends to the top of the cigarette 500, a change in the current characteristic value detected by the second detector may be great. However, if the electromagnetic inductor 580 is arranged at the bottom of the cigarette 500, the change in the current characteristic value detected by the second detector may be small.

Accordingly, the controller 240 may identify the length of the electromagnetic inductor 580 and the type of the cigarette 500 based on the current characteristic value detected by the second detector. In addition, the controller 240 may determine whether or not the type of the identified cigarette 500 coincides with the type of the predetermined cigarette 500.

The aerosol generating apparatus 200 may operate the heating unit 230 (S7500). The controller 240 may operate the heating unit 230 on the condition that the insertion of the cigarette 500 is detected based on the current characteristic value detected by the first detector 262, and the type of the inserted cigarette 500 coincides with a predetermined type of the cigarette 500 according to the current characteristic value detected by the second detector 264.

Figure 23:
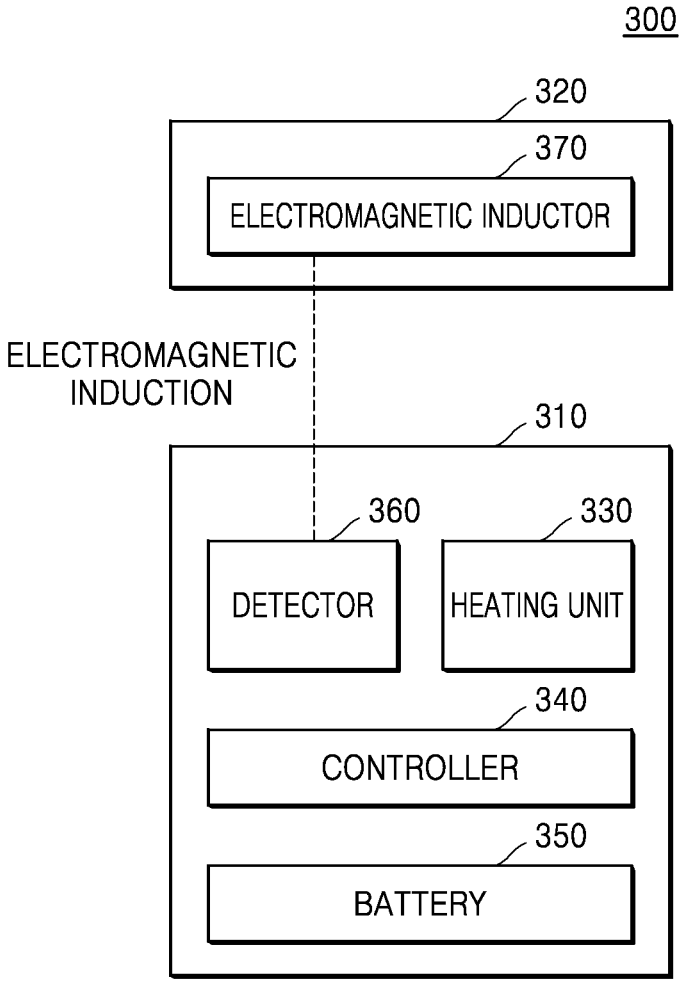
FIG. 23 is a block configuration diagram of an aerosol generating apparatus according to another embodiment.

FIG. 23 is a block configuration diagram of an aerosol generating apparatus according to another embodiment.

Referring to FIG. 23, a cover 320 may include an electromagnetic inductor 370, and an aerosol generating apparatus 300 may include a detector.

Description about the detectors 160, 262, and 264, the heating units 130 and 230, the controllers 140, 240, the batteries 150 and 250, and so on with reference to FIGS. 1 to 22 may be applied to a detector 360, a heating unit 330, a controller 340, and a battery 350 of the aerosol generating apparatus 300 according to another embodiment.

The cover 320 may be coupled to or separated from a case 310.

Since the electromagnetic inductor 370 is provided on the cover 320 and moves together with the cover 320, the aerosol generating apparatus may determine a coupling state of the cover 320 by detecting the electromagnetic inductor 370.

When coupled to the case 310, the cover 320 may prevent heat generated from the heating unit 330 from being transferred to the outside of the aerosol generating apparatus 300. Thereby, it is possible to prevent an injury that may occur when a user comes into direct contact with the heating unit 330 inadvertently or comes into contact with a region of the case 310 heated by the heating unit 330 during the operation of the heating unit 330. Accordingly, the heating unit 330 needs to operate while the cover 320 is coupled.

The electromagnetic inductor 370 may be disposed in various forms on the cover 320. For example, the electromagnetic inductor 370 may be disposed in a circumferential direction of the cover 320. As another example, the electromagnetic inductor 370 may be disposed on one side of the cover 320 which faces the detector 360 when the cover 320 is coupled to the case 310. As another example, the electromagnetic inductor 370 may have a shape elongated in a longitudinal direction of the cover 320. The shape and disposition of the electromagnetic inductor 370 are not limited to the above-described description, and the electromagnetic inductor 370 may be disposed in any form that may be effectively detected through electromagnetic induction under interaction with the detector 360.

The electromagnetic inductor 370 may include an insulating material. For example, the electromagnetic inductor 370 may include graphite. Specifically, the graphite may be disposed in the circumferential direction of the cover 320 and may surround the heating unit 330 when the cover 320 is coupled to the case 310. As such, the electromagnetic inductor 370 may generate an insulating effect that prevents heat of the surrounded heating unit 330 from being transmitted to the outside.

When the cover 320 and the case 310 are coupled to each other, a separation distance between the electromagnetic inductor 370 and the detector 360 may be reduced. The detector 360 may detect a change in a current flowing through a coil, which is generated as the electromagnetic inductor 370 approaches. The controller 340 may determine that the cover 320 is coupled to the case 310 based on the detected change in characteristics of a current. In contrast to this, when the cover 320 is separated from the case 310, a separation distance between the electromagnetic inductor 370 and the detector 360 may increase, and the detector 360 may detect a change in a current flowing through the coil, which is generated accordingly. The controller 340 may determine that the cover 320 is separated from the case 310 based on the detected change in characteristics of the current.

Figure 24:
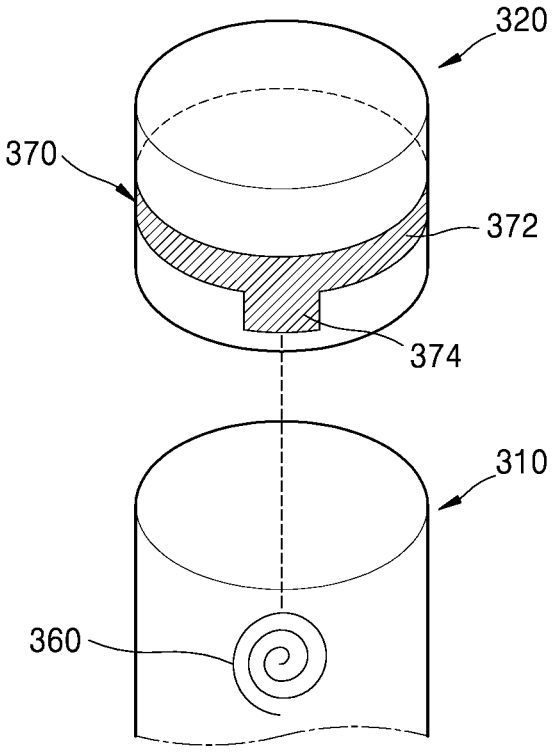
FIG. 24 is a perspective view of a cover constituting an aerosol generating apparatus.

FIG. 24 is a perspective view of a cover constituting an aerosol generating apparatus.

Referring to FIG. 24, the cover 320 may have a cylindrical shape having an empty space formed therein so as to be coupled to the case 310. The electromagnetic inductor 370 may include a first body 372 disposed in a circumferential direction of the cover 320 and a second body 374 extending in a longitudinal direction of the cover 320 from one portion of the first body 372.

The first body 372 may surround the entire circumference of the cover 320. Alternatively, the first body 372 may be disposed only on a part of the circumference of the cover 320. In this case, the part of the circumference of the cover 320 in which the first body 372 is disposed may correspond to a region of the cover 320 which faces the detector 360 when the cover 320 is coupled to the case 310. That is, the first body 372 may not be disposed in other region of the cover 320 that does not face the detector 360.

When the cover 320 is coupled to the case 310, the second body 374 may be located in a region of the cover 320 which faces the detector 360. The second body 374 is disposed in a longitudinal direction of the cover 320 in a region of the cover 320 facing the detector 360 to amplify a change in a current induced in the coil. Thereby, the detector 360 may more effectively detect a change in a current according to a coupling state of the cover 320. That is, a location of the second body 374 may specify a direction in which the cover 320 is coupled to the case 310.

According to FIG. 24, the second body 374 is square, but the shape of the second body 374 is not limited thereto and may be designed in various shapes such as a triangle, other polygons, and a curved shape including a semicircular shape.

According to FIG. 24, the second body 374 is illustrated to extend downwards from the first body 372 but is not limited thereto, and the second body 374 may extend upwards from the first body 372, or the second body 374 may simultaneously extend in both directions from the first body 372.

Figure 25:
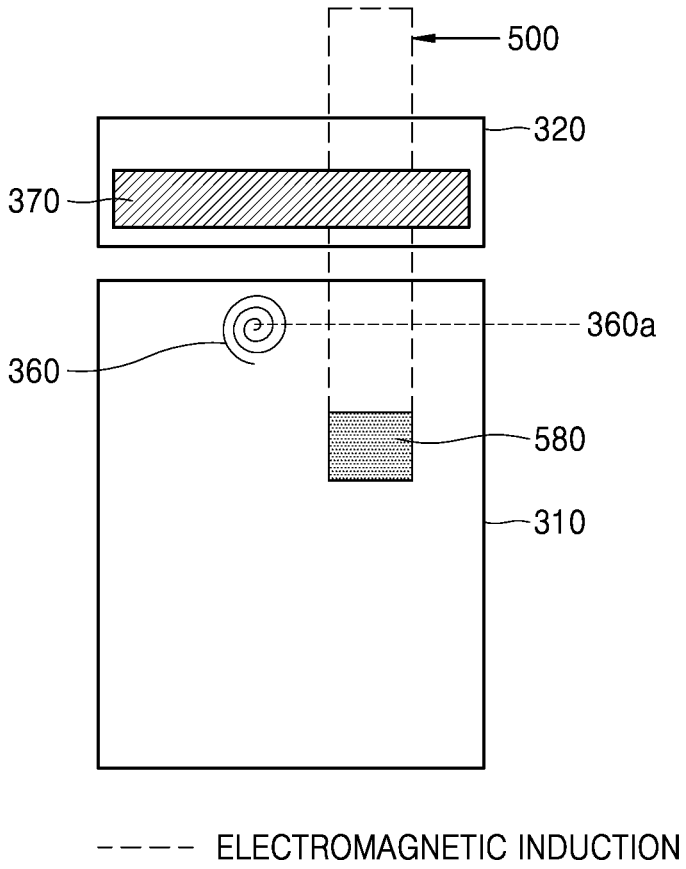
FIG. 25 is a view illustrating a state in which a cigarette is inserted into an aerosol generating apparatus.

FIG. 25 is a diagram of a state in which a cigarette is inserted into an aerosol generating apparatus.

Referring to FIG. 25, the aerosol generating apparatus 300 may determine a coupling state of the cover 320 and an insertion state of the cigarette 500 by using an electromagnetic induction action between a coil in the detector 360 and the electromagnetic inductors 370 and 580.

The change in characteristics of a current of the coil generated by the electromagnetic inductor 370 of the cover 320 may be different from the change in characteristics of a current of the coil generated by the electromagnetic inductor 580 of the cigarette 500. For example, a frequency change of a current generated when the cover 320 is coupled may be greater than a frequency change of a current generated when the cigarette 500 is inserted. Through this, the controller 340 may distinguish and identify a coupling state of the cover 320 and an insertion state of the cigarette 500, respectively. This will be described below in more detail with reference to FIG. 26.

Referring to FIG. 25, the detector 360 may be located between the electromagnetic inductor 370 of the cover 320 and the electromagnetic inductor 580 of the cigarette 500. Specifically, a center 360*a* of the coil may be located below the electromagnetic inductor 370 of the cover 320 in the coupling state of the cover 320 and may be located above the electromagnetic inductor 580 of the cigarette 500 in the insertion state of the cigarette 500. Thereby, the detector 360 may detect effectively and simultaneously a change in characteristics of a current according to the coupling state of the cover 320 and a change in characteristics of a current according to the insertion state of the cigarette 500.

For example, the electromagnetic inductor 580 may be disposed at a location horizontal to one portion in the first segment 521. If the cover 320 is coupled to the case 310, the electromagnetic inductor 370 may be disposed at a location horizontal to one portion in the second segment 522. At this time, the center 360*a* of the coil may be disposed horizontally with one portion in the first segment 521 located above the electromagnetic inductor 580 when the cigarette 500 is inserted.

The center of the coil is located between the electromagnetic inductor 370 of the cover 320 and the electromagnetic inductor 580 of the cigarette 500, but it does not require that there be no overlapping region between the detector 360 and the electromagnetic inductor 370 of the cover 320 or the electromagnetic inductor 580 of the cigarette 500.

According to an embodiment, the coil of the detector 360 may be disposed such that an extension direction of the centerline is directed toward the cigarette 500 inserted in the case 310. The coil may be disposed so that the extension direction of the centerline is parallel to the horizontal direction (that is, a direction perpendicular to a direction of gravity). This disposition is effective in detecting a change in a current due to the electromagnetic inductor 370 of the cover 320 and the electromagnetic inductor 580 of the cigarette 500.

Figure 26:
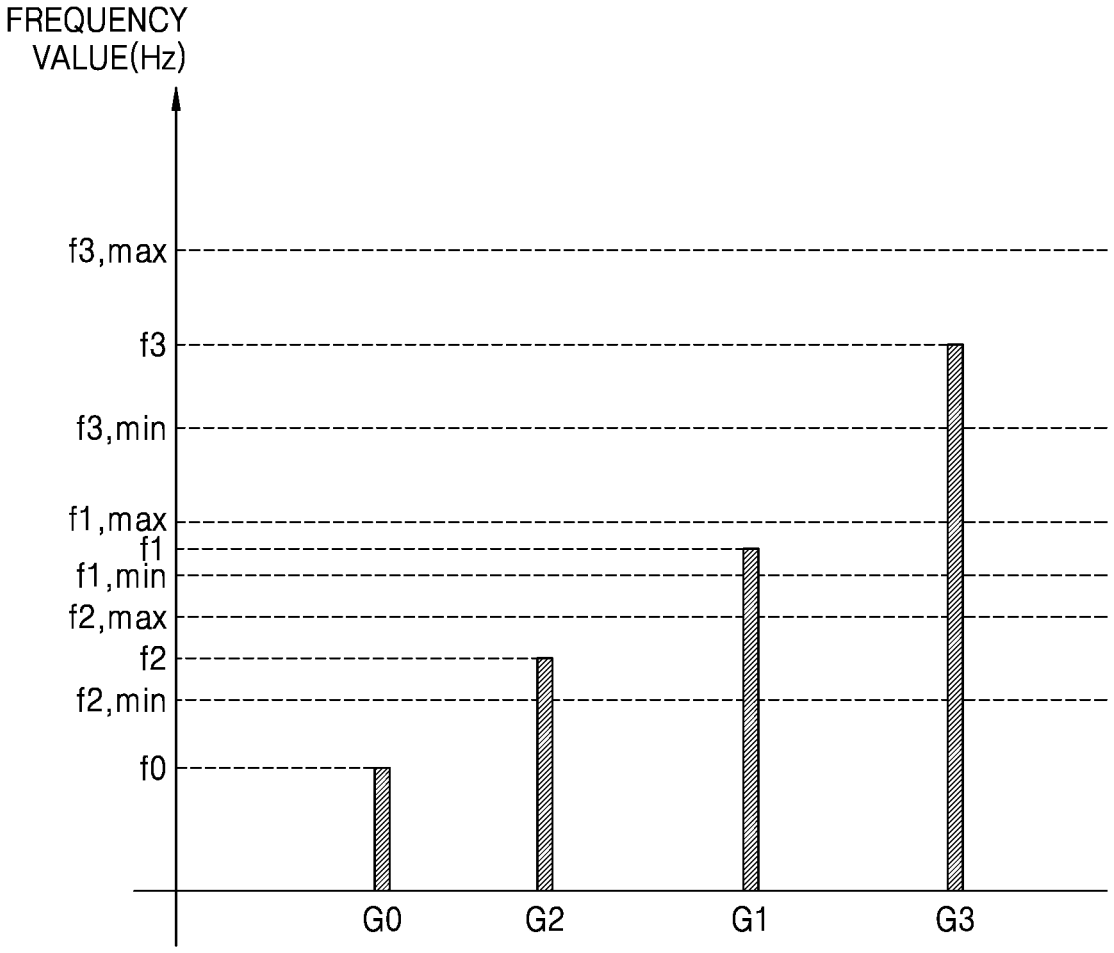
FIG. 26 is a graph of current characteristic values detected by an aerosol generating apparatus.

FIG. 26 is a graph of current characteristic values detected by the aerosol generating apparatus.

Referring to FIG. 26, the detector 360 may detect, for example, a change in a frequency of a current among the current characteristic values, and the controller 340 may determine a coupling state of the cover 320 and an insertion state of the cigarette 500 based thereon.

The content which will be described below is not limited to the frequency value, and may be applied to other current characteristic values in that a degree of a change in the current characteristic value is detected and compared with a reference value.

Moreover, the current characteristic values may be physical quantities that may be converted to each other by calculation. Accordingly, measuring one current characteristic value also includes obtaining another current characteristic value by using the measured current characteristic value.

The controller 340 may previously set the minimum reference frequency value (f1,min) and the maximum reference frequency value (f1,max). When a frequency value of a signal measured by the detector 360 is greater than or equal to the minimum reference frequency value (f1,min) and is less than the maximum reference frequency value (f1,max), the controller 340 may determine that the cover 320 is coupled.

For example, when the detector 360 detects a signal G0, the controller 340 may determine that the cover 320 is not coupled to the case 310 because a frequency value f0 of the signal G0 is less than the minimum reference frequency value (f1,min).

TABLE 1

| | Basic signal (Hz) | Signal (Hz) when cover 320 is coupled |
|---|---|---|
| 1 | 10078063 | 10168400 |
| 2 | 10078340 | 10168685 |
| 3 | 10078125 | 10168617 |
| 4 | 10078135 | 10168902 |
| 5 | 10077993 | 10168822 |
| 6 | 10078277 | 10169129 |
| 7 | 10078046 | 10168602 |
| 8 | 10077708 | 10168750 |
| 9 | 10077599 | 10168578 |
| 10 | 10077908 | 10168810 |

Table 1 is data relating to a frequency of a current flowing through a coil, which is detected by the detector 360. The detector 360 measures a basic signal in a state in which the cover 320 is not coupled. If the cover 320 is coupled, the frequency of the current flowing through the coil may increase by a certain amount.

The minimum reference frequency value (f1,min) may be set to a value that is greater than or equal to a frequency of the basic signal and is less than a frequency of a signal when the cover 320 is coupled.

In the above-described example, the frequency value of the signal when the cover 320 is coupled is greater than the frequency value of the basic signal, but according to another embodiment, the frequency value of the signal when the cover 320 is coupled may be measured to be smaller than the frequency value of the basic signal according to a shape and disposition of the detector 360, a shape and disposition of the electromagnetic inductor 370, and so on.

The controller 340 may previously set the minimum reference frequency value (f1,min) and the maximum reference frequency value (f1,max) for determining the coupling state of the cover 320, a minimum reference frequency value (f2,min) and a maximum reference frequency value (f2,max) for determining the coupling state of the cigarette 500, a minimum reference frequency value (f3,min) and a maximum reference frequency value (f3,max) for determining a state in which the cover 320 is coupled and the cigarette 500 is inserted. The respective reference frequency values may be set in consideration of the basic signal G0 influenced by a metallic material of the case 310 itself.

When a frequency value of a signal measured by the detector 360 is greater than or equal to the minimum reference frequency value (f1,min) and is less than the maximum reference frequency value (f1,max), the controller 340 may determine that the cover 320 is coupled.

When the frequency value of the signal measured by the detector 360 is greater than or equal to the minimum reference frequency value (f2,min) and is less than the maximum reference frequency value (f2,max), the controller 340 may determine that the cigarette 500 is inserted.

When the frequency value of the signal measured by the detector 360 is greater than or equal to the minimum reference frequency value (f3,min) and is less than the maximum reference frequency value (f3,max), the controller 340 may determine that the cigarette (500) is inserted.

For example, when the detector 360 detects the frequency value f0 of the signal G0, the controller 340 may determine that the cover 320 is not coupled and the cigarette 500 is not inserted because the frequency value f0 of the signal G0 is less than the minimum reference frequency value (f2,min).

When the detector 360 detects a frequency value f1 of a signal G1, the controller 340 determines that the cover 320 is coupled because the frequency value f1 of the signal G1 is greater than or equal to the minimum reference frequency value (f1,min) and is less than the maximum reference frequency value (f1,max).

When the detector 360 detects a frequency value f2 of a signal G2, the controller 340 may determine that the cigarette 500 is inserted because the frequency value f2 of the signal G2 is greater than or equal to the minimum reference frequency value (f2,min) and is less than the maximum reference frequency value (f2,max).

When the detector 360 detects a frequency value f3 of a signal G3, the controller 340 may determine that the cover 320 is coupled and the cigarette 500 is inserted because the frequency value f3 of the signal G3 is greater than or equal to the minimum reference frequency value (f3,min) and is less than the maximum reference frequency value (f3,max).

TABLE 2

| | Basic signal (Hz) | Signal (Hz) when cover 320 is coupled | Signal (Hz) when cover 320 is coupled and cigarette 500 is inserted |
|---|---|---|---|
| 1 | 10078063 | 10168400 | 10269476 |
| 2 | 10078340 | 10168685 | 10269865 |
| 3 | 10078125 | 10168617 | 10269791 |
| 4 | 10078135 | 10168902 | 10269841 |
| 5 | 10077993 | 10168822 | 10269811 |
| 6 | 10078277 | 10169129 | 10269279 |

TABLE 2-continued

| | Basic signal (Hz) | Signal (Hz) when cover 320 is coupled | Signal (Hz) when cover 320 is coupled and cigarette 500 is inserted |
|---|---|---|---|
| 7 | 10078046 | 10168602 | 10269678 |
| 8 | 10077708 | 10168750 | 10269496 |
| 9 | 10077599 | 10168578 | 10269629 |
| 10 | 10077908 | 10168810 | 10269555 |

Table 2 is data relating to a frequency of a current flowing through a coil, which is detected by the detector 360.

According to Table 2, the frequency value of the signal when the cover 320 is coupled is greater than the frequency value of the basic signal, and the frequency of the signal when the cover 320 is coupled and the cigarette 500 is inserted is greater than the frequency of the signal when the cover 320 is coupled.

Accordingly, the minimum reference frequency value (f1,min) may be set to be greater than the frequency value of the basic signal and to be less than the frequency value of the signal when the cover 320 is coupled. Also, the maximum reference frequency value (f1,max) may be set to be greater than the frequency value of the signal when the cover 320 is coupled and to be less than the frequency value of the signal when the cover 320 is coupled and the cigarette 500 is inserted. In addition, the minimum reference frequency value (f3,min) may be set to be greater than the frequency value of the signal when the cover 320 is coupled, and the maximum reference frequency value (f3,max) may be set to be less than the frequency value of the signal when the cover 320 is coupled and the cigarette 500 is inserted.

According to an embodiment, the coil and electromagnetic inductors 580 and 370 may be designed so that the frequency value f1 of the signal G1 when the cover 320 is coupled is greater than the frequency value f2 of the signal G2 when the cigarette 500 is inserted. Accordingly, the minimum reference frequency value (f1,min) for determining the coupling state of the cover 320 may be set to be greater than the minimum reference frequency value (f1, min) for determining the insertion state of the cigarette 500.

According to an embodiment, a frequency range defined by a difference between the maximum reference frequency value (f2,max) and the minimum reference frequency value (f2,min) for determining the insertion of the cigarette 500 may be set to be wider than a frequency range defined by a difference between the maximum reference frequency value (f1,max) and the minimum reference frequency value (f1, min) for determining coupling of the cover 320. There are a number of types of the cigarette 500, according to a tobacco raw material, additives, a production form of the tobacco rod 51, and so on. The aerosol generating apparatus 300 may identify the type of the cigarette 500 inserted into the case 310 by using a change in a current detected by the detector 360. To this end, a value of a change in a current induced in a coil may be specifically set according to the type of the cigarette 500. The aerosol generating apparatus 300 may provide an optimized heating scenario for the inserted cigarette 500 by adjusting an intensity of heating, a maximum heating temperature, a minimum heating temperature, and so on according to the identified type of the cigarette 500.

According to Table 2, as the cover 320 is coupled and the cigarette 500 is inserted, a frequency value of a signal sequentially increases. However, according to another embodiment, the frequency value of the signal may decrease as the cover 320 is coupled or the cigarette 500 is inserted, according to a shape and disposition of the detector 360, a shape and disposition of the electromagnetic inductors 580 and 370, and so on.

Figure 27:
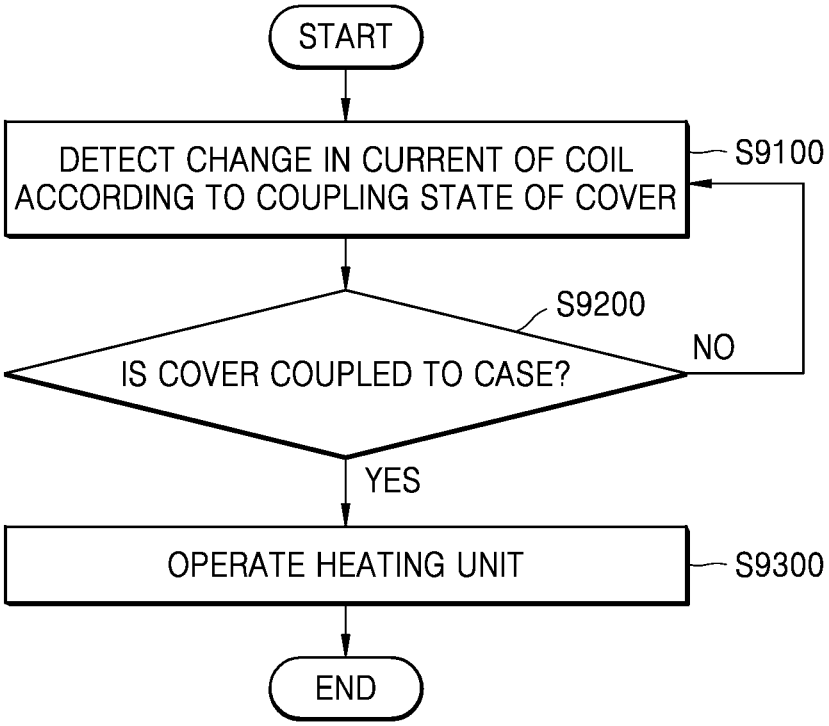
FIG. 27 is a flowchart illustrating a method by which an aerosol generating apparatus operates according to a coupling state of a cover.

FIG. 27 is a flowchart illustrating a method by which an aerosol generating apparatus operates according to a coupling state of a cover.

Referring to FIG. 27, the aerosol generating apparatus 300 may detect a change in current characteristics of a coil according to the coupling state of the cover 320 (S9100). The detector 360 may detect the change in the current characteristics of the coil, which is caused by electromagnetic induction as the cover 320 is coupled or separated.

The aerosol generating apparatus 300 may determine the coupling state of the cover 320 (S9200). A method by which the controller 340 determines the coupling state of the cover 320 may be various. For example, the detector 360 may detect a change in a frequency of a current flowing through the coil, and the controller 340 may determine the coupling state of the cover 320 by comparing a frequency value of the detected current with a preset reference frequency value.

As another example, the controller 340 may obtain an inductance value of a coil by performing calculation based on the detected current. The controller 340 may determine the coupling state of the cover 320 by comparing the detected inductance value of the coil with an inductance value of a preset reference coil.

For another example, the controller 340 may obtain at least one of a quality factor, an effective resistance, and an impedance value of the coil by performing calculation based on the detected current. The controller 340 may determine the coupling state of the cover 320 based on the obtained quality factor, effective resistance, and impedance value of the coil.

The aerosol generating apparatus 300 may control the heating unit 330 to operate (S9300). The aerosol generating apparatus 300 may operate the heating unit 330 when the cover 320 is coupled to the case 310. Here, operating the heating unit 330 may include not only immediately heating the heating unit 330, but also allowing the heating unit 330 to operate.

By contrast, when the cover 320 is not coupled to the case 310, the aerosol generating apparatus 300 may not operate the heating unit 330. For example, when the cover 320 is not coupled to the case 310, the aerosol generating apparatus 300 may not start a heating operation even if a user input for smoking is received. In addition, for example, when the cover 320 is separated from the case 310 during the operation of the heating unit 330, the aerosol generating apparatus 300 may stop the operation of the heating unit 330.

Figure 28:
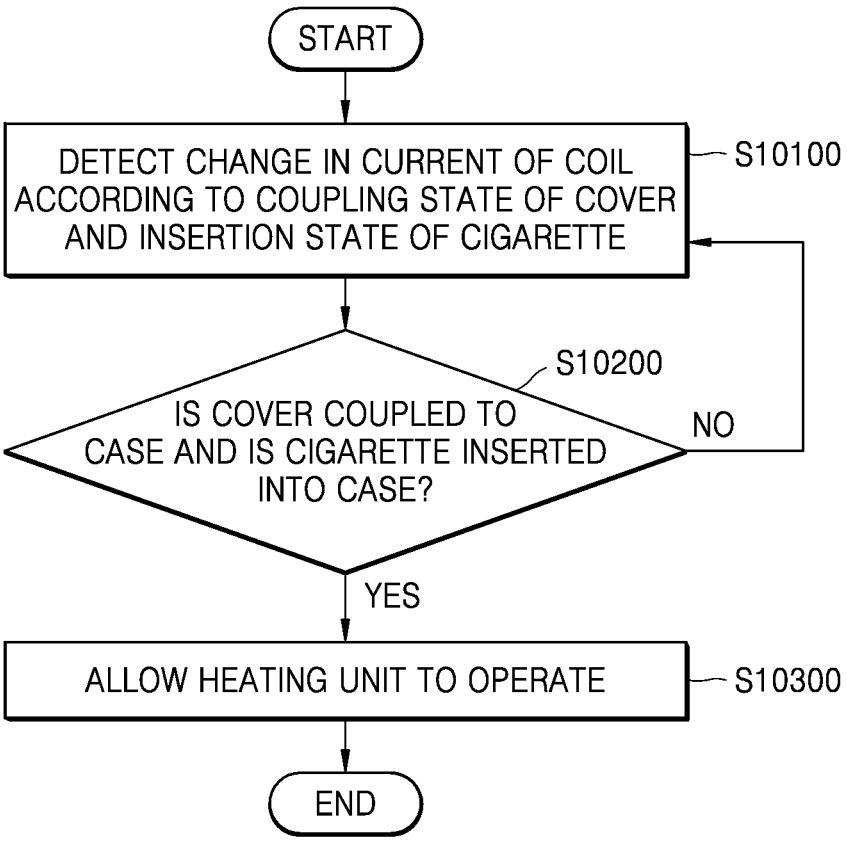
FIG. 28 is a flowchart illustrating a method by which an aerosol generating apparatus operates according to a cover coupling state and an insertion state of a cigarette.

FIG. 28 is a flowchart illustrating a method by which an aerosol generating apparatus operates according to a coupling state of a cover and an insertion state of a cigarette.

Referring to FIG. 28, the aerosol generating apparatus 300 may detect a change in the current characteristics of the coil according to the coupling state of the cover 320 and the insertion state of the cigarette 500 (S10100). A change in characteristics of a current detected by the detector 360 may include a change in various properties of currents, such as a change in the current value, a change in a voltage, and a change in a frequency of an alternating current.

The aerosol generating apparatus 300 may determine the coupling state of the cover 320 and the insertion state of the cigarette 500 (S10200). The controller 340 may individually determine the coupling state of the cover 320 and the insertion state of the cigarette 500 based on the change in characteristics of the current detected by the detector 360. That is, the controller 340 may detect whether the cover 320 is coupled alone, whether the cigarette 500 is inserted alone, whether both the cover 320 and the cigarette 500 are inserted, and so on.

The content described in step S10200 may also be applied to step S4200.

The aerosol generating apparatus 300 may control the heating unit 330 to operate (S10300). The aerosol generating apparatus 300 may operate the heating unit 330 only when the cover 320 is coupled and the cigarette 500 is inserted. The content described in step S9300 with respect to the operation of the heating unit 330 may also be applied in step S10300.

The aerosol generating apparatus 300 may not operate the heating unit 330 when the cover 320 is not coupled or the cigarette 500 is not inserted.

However, according to an embodiment, exceptionally, in order to vaporize residues of the cigarette 500 after smoking is completed, the heating unit 330 may operate in a state in which the cover 320 is coupled and the cigarette 500 is not inserted.

Figure 29:
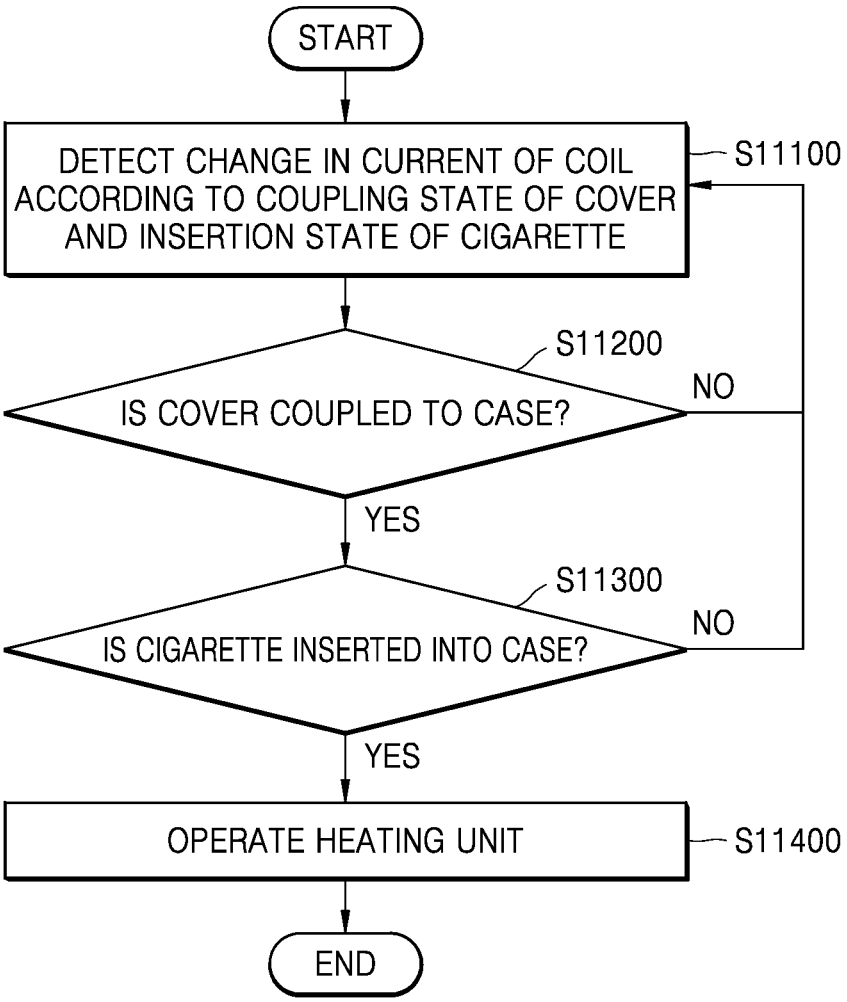
FIG. 29 is a flowchart illustrating another method by which an aerosol generating apparatus operates according to a cover coupling state and an insertion state of a cigarette.

FIG. 29 is a flowchart illustrating another method by which an aerosol generating apparatus operates according to a coupling state of a cover and an insertion state of a cigarette.

Referring to FIG. 29, the aerosol generating apparatus 300 may detect a change in characteristics of a current of the coil according to the coupling state of the cover 320 and the insertion state of the cigarette 500 (S11100). A change in a current detected by the detector 360 may include a change in various properties of currents, such as a change in a current value, a change in a voltage, and a change in a frequency of an alternating current. The content described in step S9100 and step S10100 may also be applied to step S11100.

The aerosol generating apparatus 300 may determine the coupling state of the cover 320 (S11200). The controller 340 may use various methods of determining the coupling state of the cover 320 based on the change in the current detected by the detector 360. The content described in steps S9200 and S10200 may also be applied to step S11200.

The aerosol generating apparatus 300 may determine whether or not the cigarette 500 is inserted and subsequently, may determine whether or not the cover 320 is coupled. However, the aerosol generating apparatus 300 may not further determine the insertion state of the cigarette 500 when the cover 320 is separated. In this case, the aerosol generating apparatus 300 may control the heating unit 330 not to operate.

The aerosol generating apparatus 300 may determine the insertion state of the cigarette 500 (S11300). The controller 340 may use various methods of determining the insertion state of the cigarette 500 based on the change in the current change detected by the detector 360. The content described in steps S9200 and S10200 may also be applied to step S11300.

The aerosol generating apparatus 300 may operate the heating unit 330 when the cigarette 500 is inserted. However, when the cigarette 500 is not inserted, the aerosol generating apparatus 300 may not operate the heating unit 330.

The aerosol generating apparatus 300 may operate the heating unit 330 (S11400). Through the above-described processes, the aerosol generating apparatus 300 may operate the heating unit 330 only when the cover 320 is coupled first and then the cigarette 500 is inserted. Even in a state in which the cover 320 is coupled and the cigarette 500 is inserted, the aerosol generating apparatus 300 may not operate the heating unit 330 if the cigarette 500 has been inserted first. The content described in steps S9300 and step S10300 may also be applied to step S11400.

In the above description, a configuration and characteristics of the present disclosure are described based on the embodiments according to the present disclosure, but the present disclosure is not limited to this, and it will be apparent to those skilled in the art that various modifications or changes may be made within the idea and scope of the present disclosure, and thus, it is apparent that such changes or modifications belong to the scope of the appended claims.

What is claimed is:

1. An aerosol generating apparatus comprising:

a case into which a cigarette including an electromagnetic inductor is insertable;

a heating unit configured to heat the cigarette;

a detector that includes a coil, and measures a current characteristic value of a current flowing through the coil according to predetermined time information; and a controller that controls operation of the heating unit by comparing the current characteristic value measured by the detector with a predetermined reference current characteristic value, wherein the reference current characteristic value is set based on at least one current characteristic value measured by the detector.

2. The aerosol generating apparatus of claim 1, wherein the controller updates the reference current characteristic value based on a first current characteristic value and a second current characteristic value which are measured consecutively by the detector.

3. The aerosol generating apparatus of claim 1, wherein, based on a first current characteristic value and a second current characteristic value, which are measured consecutively, being within a predetermined range, the controller updates the reference current characteristic value based on the first current characteristic value and the second current characteristic value.

4. The aerosol generating apparatus of claim 1, further comprising a temperature sensor that measures a temperature value of the detector, wherein, based on a difference between the temperature value of the detector and a predetermined reference temperature value is greater than or equal to a predetermined difference value, the controller updates the reference current characteristic value based on a first current characteristic value and a second current characteristic value which are measured consecutively.

5. The aerosol generating apparatus of claim 4, wherein the reference temperature value is the temperature value measured at a point in time when the reference current characteristic value is set.

6. The aerosol generating apparatus of claim 1, wherein, based on a difference between the current characteristic value measured by the detector and the reference current characteristic value is greater than or equal to a predetermined difference value, the controller controls the heating unit to operate.

7. The aerosol generating apparatus of claim 1, wherein the current characteristic value includes at least one of an inductance value of the coil and a frequency value of the current flowing through the coil.

8. An aerosol generating apparatus comprising:

a case into which a cigarette including an electromagnetic inductor is insertable;

a heating unit configured to heat the cigarette;

a detector that includes a coil and measures a current characteristic value of a current flowing through the coil according to predetermined time information; and a controller that controls operation of the heating unit by comparing a first current characteristic value measured by the detector with a second current characteristic value measured before the first current characteristic value.

9. The aerosol generating apparatus of claim 8, wherein the second current characteristic value and the first current characteristic value are measured consecutively.

10. The aerosol generating apparatus of claim 8, wherein, based on a difference between the first current characteristic value and the second current characteristic value is greater than or equal to a predetermined difference value, the controller controls the heating unit to operate.

11. The aerosol generating apparatus of claim 8, wherein the current characteristic value includes at least one of an inductance value of the coil and a frequency value of the current flowing through the coil.

12. An aerosol generating apparatus comprising:

a case into which a cigarette including an electromagnetic inductor is insertable;

a heating unit configured to heat the cigarette;

a detector that includes a coil and measures a current characteristic value of a current flowing through the coil according to predetermined time information; and a controller that obtains an amount of a change in the current characteristic values measured by the detector and controls operation of the heating unit based on a cumulative value of the amount of the change.

13. The aerosol generating apparatus of claim 12, wherein, based on the cumulative value being greater than or equal to a predetermined reference cumulative value, the controller controls the heating unit to operate.

14. The aerosol generating apparatus of claim 12, wherein, based on a predetermined time elapsing, the controller initializes the cumulative value.

15. The aerosol generating apparatus of claim 12, wherein, based on the cumulative value being greater than or equal to a predetermined reference cumulative value, the controller initializes the cumulative value.

* * * * *